US011429046B2

(12) United States Patent
Asaka et al.

(10) Patent No.: US 11,429,046 B2
(45) Date of Patent: Aug. 30, 2022

(54) FIXING BELT AND METHOD OF MANUFACTURING THE FIXING BELT

(71) Applicant: CANON KABUSHIKI KAISHA, Tokyo (JP)

(72) Inventors: Akeshi Asaka, Chiba (JP); Naoki Akiyama, Ibaraki (JP); Hiroto Sugimoto, Ibaraki (JP); Hiroki Muramatsu, Tokyo (JP); Yasuhiro Miyahara, Tokyo (JP); Noriaki Kobayashi, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/458,863

(22) Filed: Aug. 27, 2021

(65) Prior Publication Data

US 2022/0066370 A1 Mar. 3, 2022

(30) Foreign Application Priority Data

Sep. 3, 2020 (JP) ..... JP2020-147983

(51) Int. Cl.
*G03G 15/20* (2006.01)

(52) U.S. Cl.
CPC ..... *G03G 15/2057* (2013.01); *G03G 15/2053* (2013.01)

(58) Field of Classification Search
CPC ..... G03G 15/2053; G03G 15/2057
See application file for complete search history.

(56) References Cited

U.S. PATENT DOCUMENTS

| | | | | |
|---|---|---|---|---|
| 9,256,176 | B2 | 2/2016 | Miyahara | |
| 9,625,858 | B2 * | 4/2017 | Izutani | G03G 15/162 |
| 10,466,628 | B1 * | 11/2019 | Fukuda | C08L 79/08 |
| 2014/0348559 | A1 * | 11/2014 | Miyahara | B32B 7/00 399/329 |

FOREIGN PATENT DOCUMENTS

JP 2014-228729 A 12/2014

* cited by examiner

*Primary Examiner* — Joseph S Wong
(74) *Attorney, Agent, or Firm* — Venable LLP

(57) ABSTRACT

A rotatable endless fixing belt configured to fix a toner image borne on a recording material includes a base body and a polyimide layer. The polyimide layer is formed on an inner-circumferential-surface of the base body and configured to slide on a backup member in contact with the backup member. The polyimide layer includes filler having shape anisotropy. An orientation ratio of the filler inclined with respect to a generating line of the fixing belt by a predetermined angle or less is smaller in a first area than in a second area in a cross section of the fixing belt taken along the generating line of the fixing belt, the first area being an area formed in an inner-circumferential-surface side of the polyimide layer in a thickness direction, the second area being an area formed in a base-body side of the polyimide layer in the thickness direction.

8 Claims, 9 Drawing Sheets

FIXING BELT AND METHOD OF MANUFACTURING THE FIXING BELT

BACKGROUND OF THE INVENTION

Field of the Invention

The present invention relates to a fixing belt used in an electrophotographic or electrostatic-recording image forming apparatus and a method of manufacturing the same.

Description of the Related Art

In recent years, belt-heating fixing apparatuses are widely used for electrophotographic image forming apparatuses, such as copying machines and laser printers. The belt-heating fixing apparatus heats a toner image formed on a recording material, by using heat from a heater. Specifically, the belt-heating fixing apparatus heats the toner image via a fixing belt having a small heat capacity. In such a fixing apparatus, the fixing belt is nipped by a rotary member disposed outside the fixing belt and a backup member disposed inside the fixing belt, so that a fixing nip portion is formed between the fixing belt and the rotary member. In such a fixing apparatus, however, friction and wear may occur between the inner circumferential surface of the fixing belt and the backup member. Thus, if the fixing apparatus has been used for a long time, self-induced vibration called stick slip and torque up may occur.

For solving this problem, Japanese Patent Application Publication No. 2014-228729 discloses a fixing belt in which filler is contained in the sliding layer of the fixing belt. The sliding layer is formed on the inner circumferential surface of the fixing belt, and each of filler particles has a shape anisotropy, such as a needle shape, a whisker shape, or a fiber-shape, for increasing the orientation ratio of the filler in the rotation-axis direction of the fixing belt. The filler particles oriented in the rotation-axis direction improve the sliding property, wear resistance, and lubricant retaining property of the fixing belt, and increase the service life of the fixing belt.

However, in the above-described fixing apparatus described in Japanese Patent Application Publication No. 2014-228729, since the filler particles are oriented in the rotation-axis direction of the fixing belt, it is difficult to ensure the wear resistance strength of the fixing belt in the belt rotation direction, which is a direction in which the fixing belt and the backup member slide on each other. By the way, the fixing belt is required to have a less real-contact area with the backup member, and a sufficient surface roughness for retaining lubricant between the fixing belt and the backup member. However, since the filler particles are oriented as described above, it is difficult to effectively achieve the desired surface roughness by using a less amount of filler. If the amount of filler is increased for achieving the desired surface roughness, the wear resistance strength of the sliding layer may be deteriorated.

An object of the present invention is to provide a fixing belt whose wear resistance strength is increased, and a method of manufacturing the fixing belt.

SUMMARY OF THE INVENTION

According to a first aspect of the present invention, a rotatable endless fixing belt configured to fix a toner image borne on a recording material to the recording material by heating the toner image, the fixing belt being configured to be nipped by a rotary member disposed outside the fixing belt and a backup member disposed inside the fixing belt, a nip portion being formed between the fixing belt and the rotary member by the fixing belt being nipped by the rotary member and the backup member, the nip portion being a portion in which the toner image is fixed to the recording material, includes a base body, and a polyimide layer formed on an inner-circumferential-surface of the base body and configured to slide on the backup member in contact with the backup member. The polyimide layer comprises filler having shape anisotropy. An orientation ratio of the filler inclined with respect to a generating line of the fixing belt by a predetermined angle or less is smaller in a first area than in a second area in a cross section of the fixing belt taken along the generating line of the fixing belt, the first area being an area formed in an inner-circumferential-surface side of the polyimide layer in a thickness direction, the second area being an area formed in a base-body side of the polyimide layer in the thickness direction.

According to a second aspect of the present invention, a rotatable endless fixing belt configured to fix a toner image borne on a recording material to the recording material by heating the toner image, the fixing belt being configured to be nipped by a rotary member disposed outside the fixing belt and a backup member disposed inside the fixing belt, a nip portion being formed between the fixing belt and the rotary member by the fixing belt being nipped by the rotary member and the backup member, the nip portion being a portion in which the toner image is fixed to the recording material, includes a base body, and a polyimide layer formed on an inner-circumferential-surface of the base body and configured to slide on the backup member in contact with the backup member. The polyimide layer comprises filler having shape anisotropy. The polyimide layer comprises a plurality of Benard cells formed on an inner circumferential surface of the polyimide layer and having an average diameter equal to or larger than 50 μm and smaller than 200 μm. An arithmetic average roughness of the inner circumferential surface of the polyimide layer is equal to or larger than 0.20 μm and equal to or smaller than 0.50 μm.

According to a third aspect of the present invention, a method of manufacturing a fixing belt that fixes a toner image borne on a recording material to the recording material by heating the toner image, the fixing belt being configured to be nipped by a rotary member disposed outside the fixing belt and a backup member disposed inside the fixing belt, a nip portion being formed between the fixing belt and the rotary member by the fixing belt being nipped by the rotary member and the backup member, the nip portion being a portion in which the toner image is fixed to the recording material, the fixing belt comprising a base body and a polyimide layer formed on an inner-circumferential-surface of the base body and configured to slide on the backup member in contact with the backup member, includes coating an inner circumferential surface of the base body with a solution in which a precursor of the polyimide layer and filler are dispersed in a solvent, and drying the solvent of the solution that has been applied onto the inner circumferential surface of the base body. In the drying, the solvent is dried such that a difference between a first temperature and a second temperature is equal to or larger than 10° C. and equal to or smaller than 30° C., where the first temperature is a temperature of an outer circumferential surface of the base body and the second temperature is an ambient temperature of an inner-circumferential-surface side of the polyimide layer that is lower than the first temperature.

Further features of the present invention will become apparent from the following description of exemplary embodiments with reference to the attached drawings.

DESCRIPTION OF THE EMBODIMENTS

First Embodiment

Figure 1:
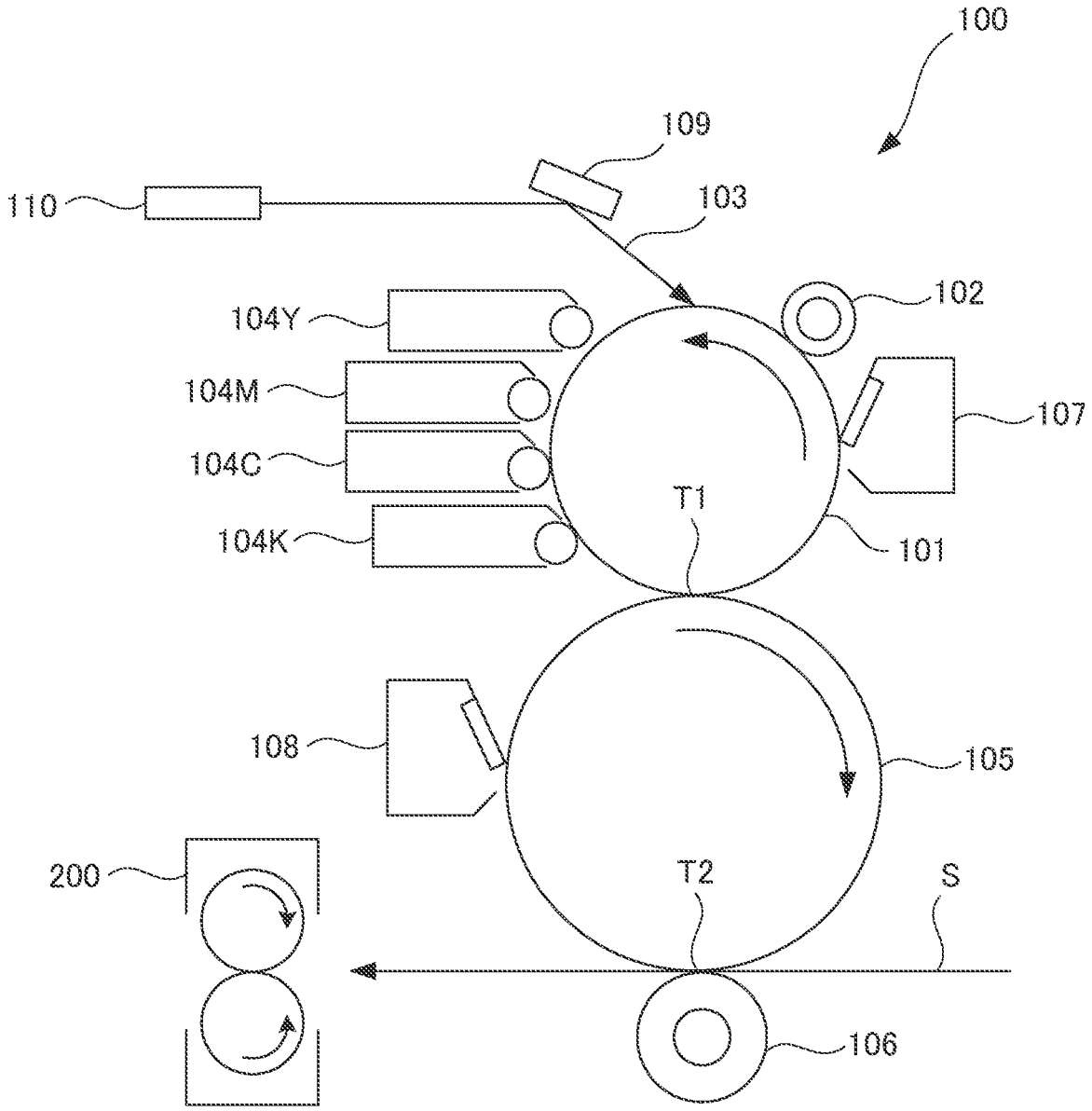
FIG. 1 is a cross-sectional view illustrating a schematic configuration of an image forming apparatus of a first embodiment.

A first embodiment will be described with reference to FIGS. 1 to 7. First, a schematic configuration of an image forming apparatus of the present embodiment will be described with reference to FIG. 1.

Image Forming Apparatus

An image forming apparatus 100 includes a photosensitive drum (photosensitive member) 101, which serves as an image bearing member. The photosensitive drum 101 is rotated in a direction indicated by an arrow, at a predetermined process speed (circumferential speed). While rotated, the surface of the photosensitive drum 101 is charged at a predetermined polarity by a charging roller 102, which serves as a charging apparatus. Then the charged surface is exposed to a laser beam 103 outputted from an exposure apparatus 110, which includes a laser optical system. The exposure process is performed in accordance with image information received by the exposure apparatus 110. The exposure apparatus 110 receives image information from an image reading apparatus (not illustrated) or an external terminal (not illustrated) such as a personal computer, then modulates (turns on and off) a laser beam in accordance with an image signal that corresponds to each color included in the image information, and then outputs the laser beam 103. In this manner, the surface of the photosensitive drum 101 is scanned by and exposed to the laser beam 103. As a result, an electrostatic latent image is formed on the surface of the photosensitive drum 101 in accordance with the image information. Note that the laser beam 103 outputted from the exposure apparatus 110 is deflected toward an exposure position on the photosensitive drum 101 by a deflecting mirror 109.

The electrostatic latent image formed on the photosensitive drum 101 is then visualized as a yellow toner image, by a developing apparatus 104Y by using yellow toner. The yellow toner image is transferred onto the surface of an intermediate transfer drum 105 in a primary transfer portion T1, which is a contact portion between the photosensitive drum 101 and the intermediate transfer drum 105. Note that the toner left on the surface of the photosensitive drum 101 is removed by a cleaner 107.

The above-described process cycle including the charging process, the exposure process, the development process, the primary transfer process, and the cleaning process is also repeated similarly for forming a magenta toner image, a cyan toner image, and a black toner image. Specifically, when a magenta toner image is formed, an electrostatic latent image corresponding to magenta and formed on the photosensitive drum 101 is visualized as the magenta toner image, by a developing apparatus 104M by using magenta toner. Similarly, a cyan toner image is visualized by a developing apparatus 104C, and a black toner image is visualized by a developing apparatus 104K.

The toner images having respective colors are sequentially formed on the intermediate transfer drum 105 such that one toner image is formed on another. The toner images are collectively secondary-transferred onto a recording material S (e.g., a paper sheet or a sheet material such as an OHP sheet) in a secondary transfer portion T2, which is a contact portion between the intermediate transfer drum 105 and a transfer roller 106. The toner left on the intermediate transfer drum 105 is removed by a toner cleaner 108. Note that the toner cleaner 108 can be brought into contact with the intermediate transfer drum 105, and can be separated from the intermediate transfer drum 105. Specifically, the toner cleaner 108 is in contact with the intermediate transfer drum 105 only when the intermediate transfer drum 105 is cleaned. In addition, the transfer roller 106 can also be brought into contact with the intermediate transfer drum 105, and can be separated from the intermediate transfer drum 105. Specifically, the transfer roller 106 is in contact with the intermediate transfer drum 105 only when toner images are secondary-transferred. The recording material S having passed through the secondary transfer portion T2 is introduced into a fixing apparatus 200, which serves as a heating apparatus. In the fixing apparatus 200, a fixing process (image heating process) is performed on a toner image that is borne on the recording material S, and that is still not fixed to the recording material S. After the fixing process is performed on the recording material S, the recording material S is discharged to the outside of the image forming apparatus 100. With this operation, a series of image forming operations is completed.

Fixing Apparatus

Next, a schematic configuration of the fixing apparatus 200 will be described with reference to FIG. 2. The fixing apparatus 200 includes a fixing belt 201 that serves as a heating member, and a pressing roller 206 that serves as a rotary member. In addition, a fixing nip portion N is formed between the fixing belt 201 and the pressing roller 206. The fixing nip portion N is a nip portion in which the recording material S introduced into the fixing apparatus 200 is nipped and conveyed. As described in detail later, the fixing belt 201 is an endless belt including a silicone-rubber elastic layer. In addition, the fixing belt 201 is a rotary member that rotates in a state where the surface (outer surface) of the fixing belt 201 is in contact with a recording material. In addition, the fixing belt 201 is a fixing rotary member that fixes a toner image formed on the recording material S, to the recording material S.

Inside the fixing belt 201, a fixing heater 202, a heater holder 204, a fixing-belt stay 205, and the like are disposed. The fixing heater 202 serves as a heating source, which heats the fixing belt 201 while pushing the fixing belt 201 toward the pressing roller 206. The fixing heater 202 may be a ceramic heater. For example, the fixing heater 202 includes an alumina substrate and a resistance heating element. The resistance heating element is a film of conductive paste that contains silver-palladium alloy, and the conductive paste is applied on the alumina substrate through screen printing such that the film has a uniform thickness of about 10 μm. The ceramic heater further includes a pressure-proof glass, and the resistance heating element is covered with the pressure-proof glass. The fixing heater 202 generates heat when current flows in the fixing heater 202.

The fixing heater 202 is disposed along the longitudinal direction of the fixing belt 201 (i.e., direction extending along the surface of the fixing belt 201 and orthogonal to the rotational direction). The inner surface of the fixing belt 201 and the heating surface of the fixing heater 202 slide on each other. Note that the inner surface of the fixing belt 201 is applied with later-described semi-solid lubricant for ensuring the sliding property between the fixing belt 201 and the fixing heater 202 and the heater holder 204.

The heater holder 204 is made of a material, such as liquid crystal polymer resin, that has high thermal resistance; and extends in the longitudinal direction of the fixing belt 201. The heater holder 204 holds the fixing heater 202, and makes the shape of the fixing belt 201 that separates the fixing belt 201 from the recording material S. That is, the fixing heater 202 is fixed to a surface of the heater holder 204 located on the pressing roller 206 side. In addition, a cylindrical supporting portion is integrated with each end portion of the heater holder 204 in the longitudinal direction of the heater holder 204. The cylindrical supporting portion is externally fitted to a corresponding end portion of the fixing belt 201 in the longitudinal direction of the fixing belt 201, such that a slight clearance is formed between the cylindrical supporting portion and the end portion of the fixing belt 201. With this configuration, the fixing belt 201 is rotatably supported while having a substantially cylindrical shape. The recording material S is easily separated from the fixing belt 201 by the curvature of the fixing belt 201.

The fixing-belt stay 205 is disposed on a surface of the heater holder 204 opposite to the fixing heater 202, along the longitudinal direction of the fixing belt 201. Both end portions of the fixing-belt stay 205 are urged toward the pressing roller 206 by a pressing mechanism (not illustrated). For example, one end portion of the fixing-belt stay 205 is urged toward the pressing roller 206 by a force of 156.8 N (16 kgf). That is, both end portions of the fixing-belt stay 205 are urged toward the pressing roller 206 by a total force of 313.6 N (32 kgf). Thus, the heating surface of the fixing heater 202 is in pressure contact with the later-described pressing roller 206 via the fixing belt 201 by a predetermined pressing force. Specifically, the heating surface of the fixing heater 202 is pressed against the pressing roller 206 by the predetermined force pressing the fixing heater 202 via the heater holder 204. As a result, the pressing roller 206 is elastically deformed, and the fixing nip portion N is formed between the fixing belt 201 and the pressing roller 206 such that the fixing nip portion N has a predetermined width required for the fixing.

The pressing roller 206 is an elastic roller having a multi-layer structure: a core metal, a silicone-rubber elastic layer, and a PFA resin tube. The silicone-rubber elastic layer is formed on the core metal and has a thickness of about 3 mm, for example. The PFA resin tube is formed on the silicone-rubber elastic layer and has a thickness of about 40 μm, for example. Note that PFA is tetrafluoroethylene-perfluoro (alkylvinyl ether) copolymer. The pressing roller 206 is disposed such that the rotation-axis direction (longitudinal direction) of the pressing roller 206 is substantially parallel with the longitudinal direction of the fixing belt 201. In addition, both end portions of the core metal in the longitudinal direction are rotatably supported, via bearings, by a back-side side plate (not illustrated) and a front-side side plate (not illustrated) of a frame 213 of the fixing apparatus 200. The pressing roller 206 is rotated by a motor (not illustrated) that serves as a driving source, at a predetermined circumferential speed in a direction indicated by an arrow. The fixing belt 201, which is in pressure contact with the pressing roller 206, is rotated by the rotation of the pressing roller 206 at a predetermined speed. The fixing belt 201 is rotated by the rotation of the pressing roller 206 in the direction indicated by the arrow, such that the inner surface of the fixing belt 201 is in close contact with the heating surface of the fixing heater 202 and slides on the heating surface, and that the fixing belt 201 is guided by the heater holder 204.

A thermistor 203 is disposed on the back surface of the fixing heater 202 (opposite to the heating surface) for detecting the temperature of the fixing heater 202. The thermistor 203 is disposed in contact with the back surface of the fixing heater 202, and connected to a control circuit portion (CPU) 210 via an A/D converter 209. The control circuit portion 210 serves as a control unit.

The control circuit portion 210 samples output values from the thermistor 203, at predetermined intervals. By using the temperature information obtained in this manner, the control circuit portion 210 performs the temperature control on the fixing heater 202. That is, the control circuit portion 210 performs the temperature control on the fixing heater 202 in accordance with the output values from the thermistor 203. Specifically, the control circuit portion 210 causes a heater-driving circuit portion 211 to flow current in the fixing heater 202 such that the temperature of the fixing heater 202 is kept at a target temperature (set temperature). The control circuit portion 210 is connected, via the A/D converter 209, with a motor that drives the pressing roller 206. Thus, the control circuit portion 210 also controls the driving of the pressing roller 206.

As described above, in the fixing apparatus 200 configured in this manner, the fixing nip portion N is formed between the fixing belt 201 and the pressing roller 206. As illustrated in FIG. 2, when the recording material S on which a toner image t is formed is conveyed in a direction indicated by an arrow, the recording material S is guided toward the fixing nip portion N by a conveyance guide 207. In addition, when the recording material S is nipped and conveyed in the fixing nip portion N, a surface of the recording material S on which the toner image t is formed is brought into contact with the fixing belt 201, and heated and pressed. As a result, the toner image t is fixed to the recording material S. After that, the recording material S is discharged to the outside of the fixing apparatus 200 by a discharging roller 208.

Configuration of Fixing Belt

Next, a configuration of the fixing belt 201 will be described in detail with reference to FIG. 3. The fixing belt 201 is a rotatable endless belt that heats a toner image borne on the recording material S and not fixed to the recording material S, and thereby fixes the toner image to the recording material S. The fixing belt 201 is nipped by the pressing roller 206 disposed outside the fixing belt 201 and the fixing heater 202 disposed inside the fixing belt 201 and serving as a backup member, so that the fixing nip portion N is formed between the fixing belt 201 and the pressing roller 206.

Figure 3:
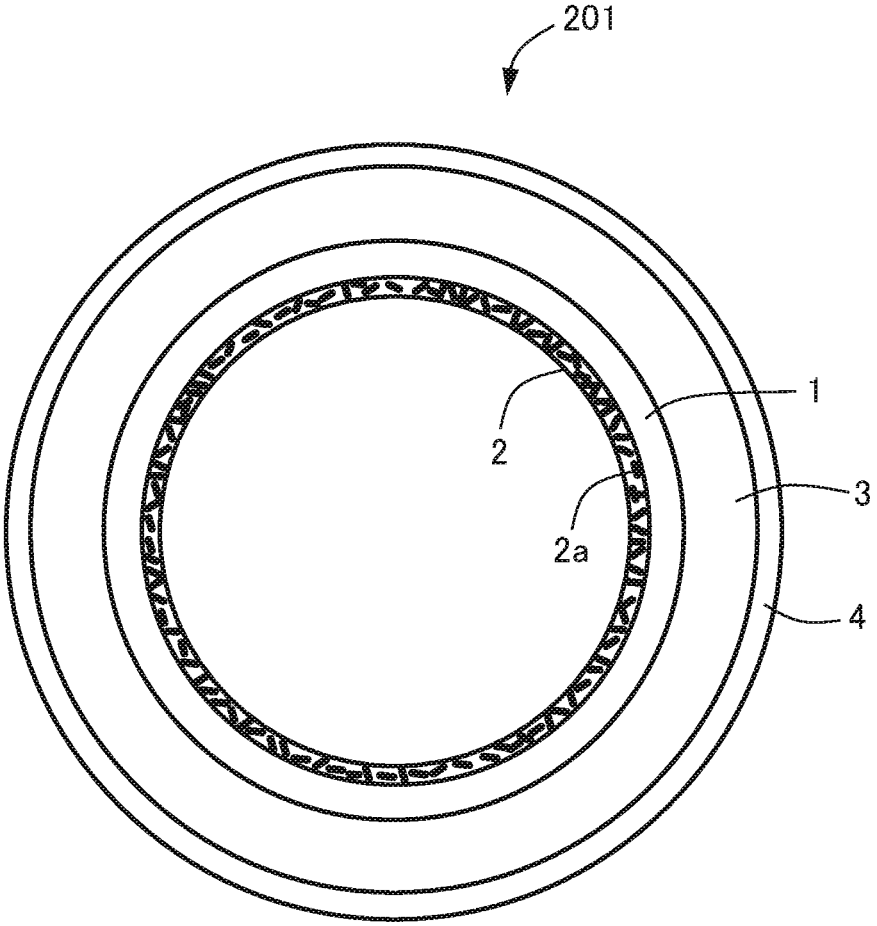
FIG. 3 is a cross-sectional view illustrating a schematic configuration of a fixing belt of the first embodiment.

As illustrated in FIG. 3, the fixing belt 201 includes an endless base body 1, a sliding layer 2, an elastic layer 3, and a release layer 4. The sliding layer 2 is formed on the inner circumferential surface of the base body 1. The sliding layer 2 is formed for increasing the sliding property between the fixing heater 202 and the fixing belt 201. Specifically, the sliding layer 2 slides on the fixing heater 202 in contact with the same, and contains filler 2*a* that has shape anisotropy. The elastic layer 3 is made of silicone rubber, and covers the outer circumferential surface of the base body 1 via a primer layer (not illustrated). The release layer (fluororesin layer) 4 is made of resin (fluororesin), and is formed on the outer circumferential surface of the elastic layer 3 via an adhesive layer (not illustrated).

Next, the above-described base body 1, sliding layer 2, elastic layer 3, and release layer 4 of the fixing belt 201 will be more specifically described.

Base Body

Since the base body 1 is required to have thermal resistance and flex resistance, the base body 1 is preferably made of a material, such as stainless steel (SUS), nickel, or nickel alloy. In addition, since the base body 1 is required to have less heat capacity and more mechanical strength, it is preferable that the thickness of the base body 1 is in a range from 20 to 50 μm, and more preferably, in a range from 25 to 45 μm. In the present embodiment, the base body 1 is made of SUS, and has an inner diameter of 24 mm and a thickness of 30 μm.

Sliding Layer

The sliding layer 2 is preferably made of a resin, such as polyimide resin, polyamide-imide resin, or polyether ether ketone resin, that has high durability and high thermal resistance. In particular, the sliding layer 2 is preferably made of polyimide resin for easily making the sliding layer 2 and ensuring its thermal resistance, elastic coefficient, and strength. If the sliding layer 2 is formed by using polyimide resin, the sliding layer 2 may be formed as follows. First, aromatic tetracarboxylic dianhydride or its derivative and aromatic diamine having the same moles as those of the aromatic tetracarboxylic dianhydride or its derivative are reacted with each other in organic polar solvent for obtaining polyimide precursor solution. Then, the polyimide precursor solution is applied onto the inner surface of the above-described base body 1, dried, and heated for subjecting the polyimide precursor solution to dehydration and ring-closure reaction (see FIG. 4). With this process, the sliding layer 2 made of polyimide resin is formed on the inner surface of the base body 1. Preferably, the thickness of the sliding layer 2 is in a range from about 5 to 25 μm. In particular, if the thickness of the sliding layer 2 is in a range from about 7 to 20 μm, both of the wear resistance and the heat transfer property of the sliding layer 2 are easily achieved in the fixing nip portion N. The heat transfer property is a property of the sliding layer 2 that transfers the heat from the heater, to the base body 1.

Polyimide Precursor Solution

Examples of the aromatic tetracarboxylic dianhydride include the following substances. The aromatic tetracarboxylic dianhydride may be one of the following substances, or may be a combination of two or more of the following substances.

(1) pyromellitic dianhydride
(2) 3,3',4,4'-biphenyltetracarboxylic dianhydride
(3) 3,3',4,4'-benzophenonetetracarboxylic dianhydride
(4) 2,3,6,7-naphthalenetetracarboxylic dianhydride Examples of the aromatic diamine include the following substances. The aromatic diamine may be one of the following substances, or may be a combination of two or more of the following substances.

(1) 4,4'-oxydianiline (4,4'-ODA)
(2) para-phenylenediamine (PPDA)
(3) meta-phenylenediamine (MPDA)

Examples of the organic polar solvent include the following substances.

(1) N,N-dimethyl acetamide (DMAc)
(2) dimethylformamide (DMF)
(3) N-Methyl-2-pyrrolidone (NMP)

Filler

Filler 2*a* is contained in the sliding layer 2 for giving the surface roughness and the wear resistance strength to the sliding layer 2. For this reason, it is preferable that each filler particle has shape anisotropy. In particular, it is preferable that each filler particle has a scaly shape. Examples of the material of the filler 2*a* include the following substances.

(1) fluorophlogopite ($KMg_3(AlSi_3)O_{10}F_2$) or potassium tetrasilicon mica ($KMg_{2.5}Si_4O_{10}F_2$), each of which is a non-swelling synthetic mica
(2) sodium tetrasilicon mica ($NaMg_{2.5}Si_4O_{10}F_2$) or sodium hectorite ($Na_{0.33}Mg_{2.67}Li_{0.33}Si_4O_{10}F_2$), each of which is a swelling synthetic mica
(3) silica ($SiO_2$) hexagonal boron nitride (BN)
(4) graphite
(5) graphene Examples of the method of dispersing the filler 2*a* in the polyimide precursor solution include the following methods.

(1) a method in which the filler 2*a* is directly added to the polyimide precursor solution, then the filler 2*a* is preliminarily agitated by using a mixing apparatus such as a mixer, and then the filler 2*a* is dispersed by using a triple roll mill or the like.
(2) a method in which the filler 2*a* is added in advance to polar solvent (such as NMP) that is similar to the polyimide precursor solution, then filler-dispersed solvent is made by using a sand mill or a bead mill, and then the filler-dispersed solvent is mixed with the polyimide precursor solution, which has been made separately from the filler-dispersed solvent, by using a mixing apparatus such as a mixer.

Preferably, the aspect ratio (i.e., ratio of long side to short side) of each particle of the filler 2*a* is about 5 or more and about 200 or less. In particular, if the aspect ratio is about 30 or more and about 100 or less, the orientation ratio of the filler 2*a* of an inner-circumferential-surface side (front-surface side) of the sliding layer 2 easily becomes smaller than the orientation ratio of the filler 2*a* of a base-body side of the sliding layer 2. The orientation ratio is a ratio at which the particles of the filler 2*a* are oriented toward a planar direction, and is obtained in a later-described process in which the polyimide precursor solution is applied and dried. With this ratio, the sliding property and the lubricant retaining property on the inner-circumferential-surface side of the sliding layer 2 are easily increased.

The optimum content of the filler 2*a* depends on the type of the polyimide precursor solution and the type of the filler 2*a*. For example, for adjusting the surface roughness of the sliding layer 2 to put the surface roughness into a proper range and keeping the proper wear resistance strength of the sliding layer 2, it is preferable that the content of the filler 2*a* is 7 volume percent or more and 15 volume percent or less with respect to the volume of the sliding layer 2. If the content of the filler 2*a* is less than 7 volume percent, the real contact area of the sliding layer 2 that contacts the member on which the sliding layer 2 slides decreases, and it becomes difficult to ensure the surface roughness required for retaining the lubricant between the member and the sliding layer 2. If the content of the filler 2*a* is more than 15 volume percent, the filler 2*a* causes the polyimide to be hard and brittle. Thus, the wear resistance strength of the sliding layer 2 deteriorates, and it becomes difficult to keep the proper surface roughness, that is, the proper sliding property and lubricant retaining property, in its service life.

Method of Forming Sliding Layer

Next, a procedure for forming the sliding layer will be described with reference to FIGS. 4 to 6. For allowing the sliding layer 2 to have a thickness of about 12 μm, the inner surface of the base body 1 is coated with polyimide precursor solution 5 that contains the filler 2*a*, by using a ring coating method or the like such that the coating of the polyimide precursor solution 5 has a thickness of about 70 to 80 μm.

Figure 4:
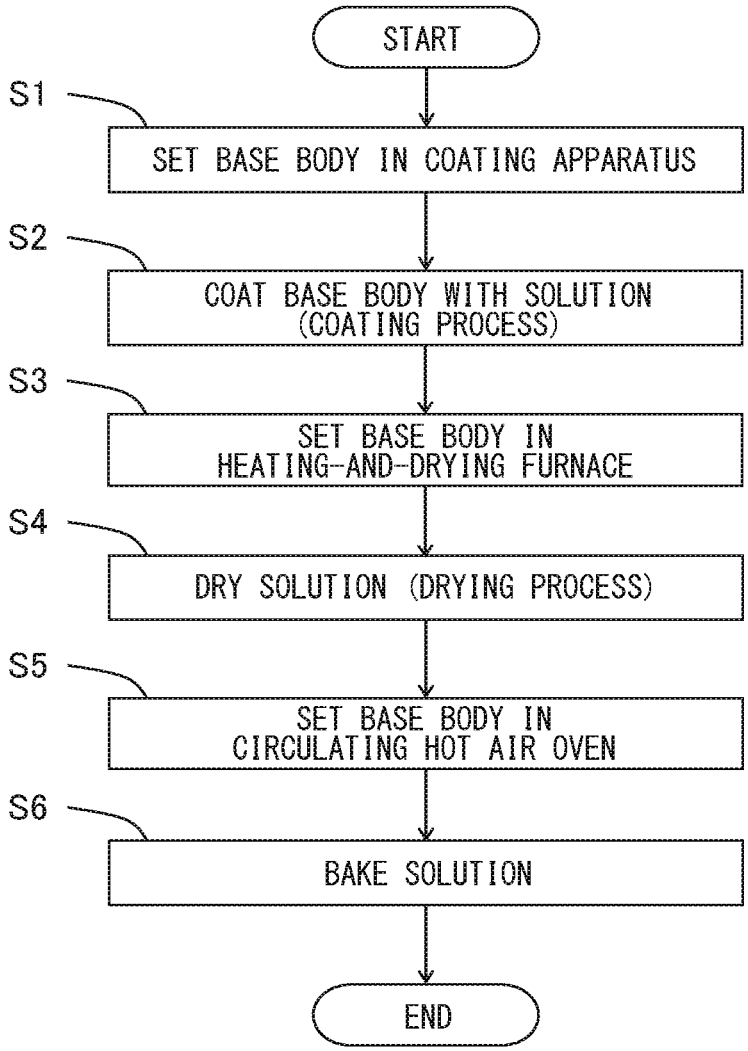
FIG. 4 is a flowchart illustrating a procedure for forming a sliding layer of the fixing belt of the first embodiment.

As illustrated in FIG. 4, the base body 1 is set in a coating apparatus 20 (Step S1), and the inner circumferential surface of the base body 1 is coated with the polyimide precursor solution 5 (Step S2: coating process). The coating process will be specifically described with reference to FIG. 5. Note that in FIG. 5, a symbol U indicates an upward direction and a symbol L indicates a downward direction.

Figure 5:
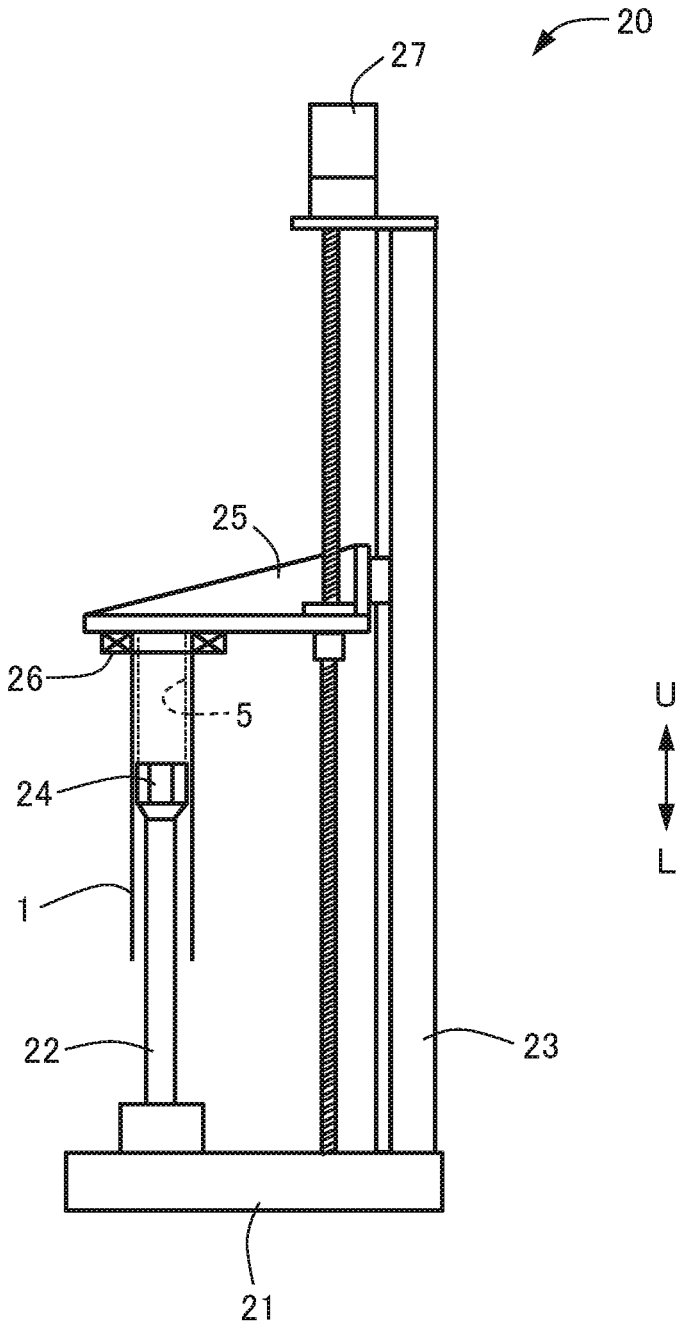
FIG. 5 is a schematic diagram illustrating a coating apparatus that forms the sliding layer of the fixing belt of the first embodiment.

FIG. 5 is a schematic diagram of the coating apparatus 20 used for the ring coating method. Pillars 22 and 23 are formed on a base 21. A coating head 24 is fixed to the top of the pillar 22, and is connected to a coating-liquid supplying apparatus (not illustrated). A workpiece moving apparatus 25 is disposed on the pillar 23 so as to be able to move up and down. The workpiece moving apparatus 25 is provided with a workpiece holding hand 26 that holds the base body 1. The workpiece moving apparatus 25 can be moved up and down by a motor 27 disposed on the pillar 23. Thus, the workpiece holding hand 26 that holds the base body 1 is also moved up and down by the movement of the workpiece moving apparatus 25.

The coating head 24 has slits (not illustrated) formed in the outer periphery of the coating head 24. The slits are orthogonal to a cylindrical shaft of the coating head 24. The polyimide precursor solution 5 that contains the filler 2*a* is uniformly supplied to the outside of the coating head 24 through the slits, and the base body 1 is moved in the up-and-down direction along the outer circumferential surface of the coating head 24. In this manner, the polyimide precursor solution 5 is applied onto the inner circumferential surface of the base body 1. The thickness of the sliding layer 2 depends on the amount of coating formed by the coating apparatus 20. Thus, any amount of coating can be obtained by changing the clearance, the supplying speed of the polyimide precursor solution 5, and the moving speed of the workpiece moving apparatus 25.

As illustrated in FIG. 4, the base body 1 onto which the polyimide precursor solution 5 has been applied is set in a heating-and-drying furnace 30 (Step S3), and the polyimide precursor solution 5 is dried (Step S4: drying process). In this manner, after the polyimide precursor solution 5 that contains the filler 2*a* is applied onto the inner surface of the base body 1, the polyimide precursor solution 5 is heated for vaporizing the organic polar solvent of the polyimide precursor solution 5 and increasing the viscosity of the polyimide precursor solution 5 to keep the shape of the sliding layer 2. The drying process will be specifically described with reference to FIG. 6. Note that in FIG. 6, a symbol U indicates an upward direction and a symbol L indicates a downward direction.

Figure 6:
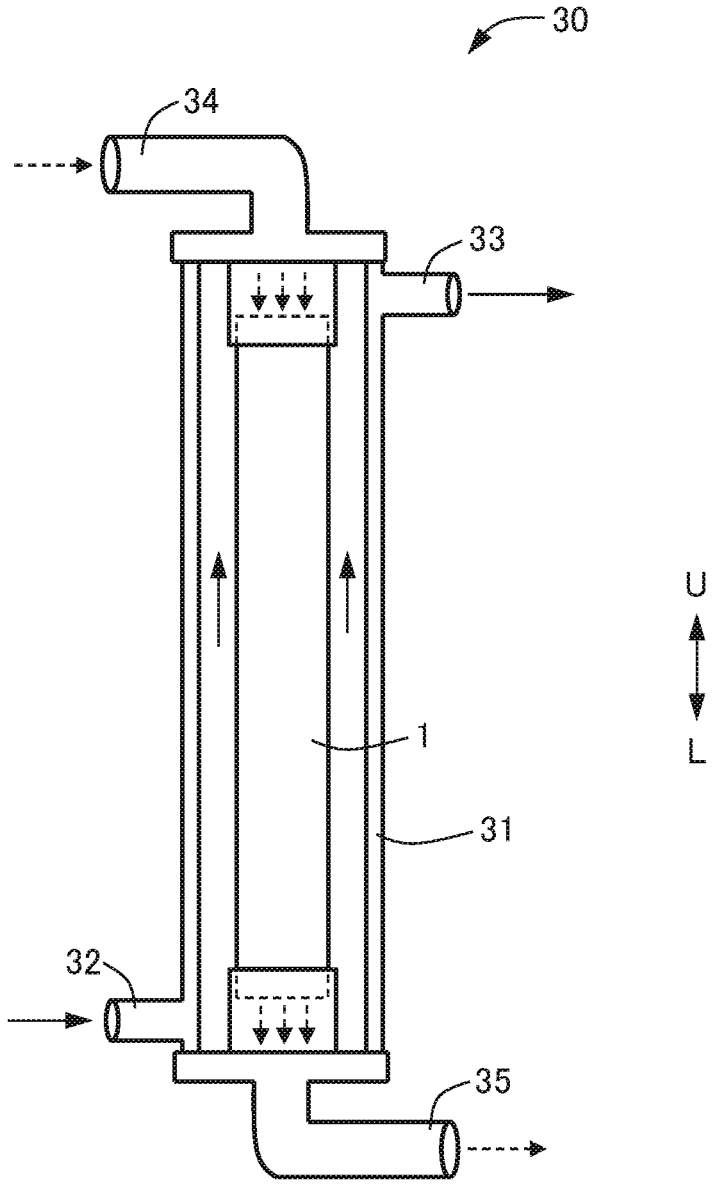
FIG. 6 is a schematic diagram illustrating a heating-and-drying furnace that forms the sliding layer of the fixing belt of the first embodiment.

FIG. 6 is a schematic diagram of the heating-and-drying furnace 30. The heating-and-drying furnace 30 includes a heating cylinder 31, an inlet 32, and an outlet 33. The heating cylinder 31 houses the base body 1. The inlet 32 is formed at a lower portion of the heating cylinder 31, and allows high-temperature oil to flow into the heating cylinder 31. The outlet 33 is formed at an upper portion of the heating cylinder 31, and allows the high-temperature oil to flow out of the heating cylinder 31. The heating-and-drying furnace 30 also includes an air inlet 34 and an air outlet 35. The air inlet 32 is formed at an upper portion of the heating cylinder 31, and allows air to flow into the heating cylinder 31. The air outlet 33 is formed at a lower portion of the heating cylinder 31, and allows the ail to flow out of the heating cylinder 31. The high-temperature oil flows through the inlet 32 into the heating cylinder 31. As indicated by solid lines, the high-temperature oil then flows through the outside of the base body 1 while heating the base body 1 from the outside, and is discharged from the outlet 33. The air is taken in through the air inlet 34. As indicated by broken lines, the air flows through the inside of the base body 1, and is discharged from the air outlet 35 together with the solvent that has vaporized from the polyimide precursor solution 5 applied to the inner circumferential surface of the base body 1.

By using the heating-and-drying furnace 30, the polyimide precursor solution 5 applied to the inner surface of the base body 1 is heated for about 300 seconds in a state where the high-temperature oil having a high temperature (e.g., 160° C.) flows through the inlet 32 into the heating cylinder 31 and is discharged from the outlet 33. With this heating, the organic polar solvent of the polyimide precursor solution 5 is reduced in volume from about 90 to about 30 or less volume percent, so that the viscosity of the polyimide precursor solution 5 is increased and the polyimide precursor solution 5 is prevented from flowing from the inner surface of the base body 1. In addition, while the organic polar solvent vaporizes, the air is taken in through the air inlet 34, flows through the inner-circumferential-surface side of the base body 1, and is discharged from the air outlet 35. Thus, the organic polar solvent can be kept at a value lower than a lower explosion limit.

That is, in the drying process, the high-temperature oil that serves as a first fluid flows through the outside of the base body 1, from the inlet 32 toward the outlet 33. The inlet 32 is formed on one end side (lower side) in the rotation-axis direction of the base body 1, and the outlet 33 is formed on the other end side (upper side). In addition, in the drying process, the air that serves as a second fluid and has a temperature lower than that of the high-temperature oil flows through the inside of the base body 1, from the air inlet 34 toward the air outlet 35. The air inlet 34 is formed on the other end side (upper side), and the air outlet 35 is formed on the one end side (lower side).

Then, as illustrated in FIG. 4, the base body 1 having the polyimide precursor solution 5 that has been dried is set in a circulating hot air oven (Step S5), and the polyimide precursor solution 5 is baked (Step S6). Specifically, after the content of the organic polar solvent is reduced to about 30 volume percent or less, the base body 1 is left in the circulating hot air oven having a high temperature (e.g., 200° C.) for 30 minutes for drying the base body 1. After that, the base body 1 is left in a circulating hot air oven having a temperature in a range from 300 to 400° C. for 20 to 120 minutes for baking the base body 1. The temperature range is a range that does not lower the fatigue strength of the base body 1. With this process, the polyimide-resin sliding layer 2 is formed in which the filler 2*a* is dispersed through dehydration and ring-closure reaction.

Elastic Layer

The elastic layer 3 is borne on the base body 1 for applying uniform pressure to concave and convex portions, formed by a toner image and the recording material S, for fixing the toner image to the recording material S. That is, the elastic layer 3 allows the fixing belt 201 to have elasticity. Thus, when a toner image is fixed to the recording material S in the fixing nip portion N, the fixing belt 201 flattens the toner image as much as necessary. In addition, if the recording material S is a paper sheet, the fixing belt 201 flexibly runs on concave and convex portions of the paper fiber. For achieving such a function, the elastic layer 3 is preferably made of cross-linked liquid silicone rubber obtained through an additional reaction. This is because the cross-linked liquid silicone rubber can be easily processed with high dimensional accuracy and does not produce reaction by-product when it hardens after heated. In addition, the elasticity of the cross-linked liquid silicone rubber can be adjusted by adjusting the degree of crosslinking in accordance with the type of the below-described filler and the amount of addition of the filler.

In general, the cross-linked liquid silicone rubber obtained through an additional reaction contains organopolysiloxane having unsaturated aliphatic group, organopolysiloxane having active hydrogen linked with silicon, and platinum compound that serves as a cross-linking catalyst. The organopolysiloxane having active hydrogen linked with silicon reacts with alkenyl group of the organopolysiloxane having unsaturated aliphatic group, through the catalytic action of the platinum compound, so that a cross-linked structure is formed.

The elastic layer 3 may contain filler for increasing the thermal conductivity, reinforcement, and thermal resistance of the fixing belt 201. In particular, it is preferable that the filler has high thermal conductivity for increasing the thermal conductivity of the fixing belt 201. Examples of the material of the filler include inorganic substance. In particular, the material may be metal or metal compound. Examples of the material of the filler with high thermal conductivity include silicon carbide (SiC), silicon nitride ($Si_3N_4$), boron nitride (BN), aluminum nitride (AlN), alumina ($Al_2O_3$), zinc oxide (ZnO), and magnesium oxide (MgO). In addition, examples of the material of the filler with high thermal conductivity include silica ($SiO_2$), cupper (Cu), aluminum (Al), silver (Ag), iron (Fe), and nickel (Ni).

The filler may be made by using a single material or by mixing two or more materials. Preferably, the average particle diameter of the filler with high thermal conductivity is equal to or larger than 1 μm and equal to or smaller than 50 μm for handling and dispersing the filler. The shape of the filler particles may be a spherical shape, a shape produced through pulverization, a plate-like shape, or a whisker-like shape. Preferably, the shape of the filler particles is a spherical shape for dispersing the filler particles. The thickness of the elastic layer 3 is preferably equal to or larger than 100 μm and equal to or smaller than 500 μm for ensuring the surface hardness of the fixing belt 201 and the efficiency of heat conduction to a toner image, which is performed for fixing the toner image to the recording material. More preferably, the thickness of the elastic layer 3 is equal to or larger than 200 μm and equal to or smaller than 400 μm. In the present embodiment, the filler with high thermal conductivity is made of alumina, the thermal conductivity of the elastic layer 3 is 1.0 W/mK, and the thickness of the elastic layer 3 is 300 μm.

Release Layer

The release layer 4 used may be a molded tube made of a resin, such as PFA, PTFE, or FEP. Note that PFA is tetrafluoroethylene-perfluoro (alkylvinyl ether) copolymer, PTFE is polytetrafluoroethylene, and FEP is tetrafluoroethylene-hexafluoropropylene copolymer. Among the above-described materials, PFA is preferably used for making the release layer 4, for the ease of molding and the toner releasability.

The thickness of the release layer 4 is preferably equal to or smaller than 50 μm. This is because if the release layer 4 has the above-described thickness, the release layer 4 keeps the elasticity of the elastic layer 3 formed under the release layer 4, and suppresses the surface hardness of the fixing member from excessively increasing. The inner surface of the fluororesin tube can be increased in adhesiveness by performing sodium treatment, excimer laser treatment, or ammonia treatment on the inner surface in advance. In the present embodiment, the release layer 4 is a PFA tube made through extrusion molding and having a thickness of 20 μm. The inner surface of the tube is subjected to the ammonia treatment for increasing wettability with a later-described adhesive.

A PFA tube 1*e* that serves as the release layer 4 is fixed to the elastic layer 3 via a silicone-rubber adhesive layer. The silicone-rubber adhesive layer is made by coating the surface of the elastic layer 3 with a silicone-rubber adhesive cured through an additional reaction, and by curing the silicone rubber adhesive. The silicone rubber adhesive cured through an additional reaction may be a silicone rubber cured through an additional reaction, which contains self-adhesiveness component, such as silane, and has a functional group such as an acryloxy group, hydrosilyl group (SiH group), an epoxy group, or an alkoxysilyl group. The silicone rubber adhesive cured through an additional reaction is cured and forced to adhere to the elastic layer 3 and the release layer 4 by heating the silicone rubber adhesive for a predetermined time in a heating unit such as an electric furnace. Both end portions of the silicone-rubber adhesive layer are cut so that the fixing belt 201 has a desired length, so that the fixing belt 201 is obtained as the fixing member of the present embodiment.

EXAMPLES AND COMPARATIVE EXAMPLES

Hereinafter, examples and comparative examples will be described. In the examples and the comparative examples, the sliding layer 2 was made, with the drying temperature and the blending ratio of the filler 2*a* being changed. In the examples and the comparative examples, the sliding layer 2 was made, with the drying temperature and the blending ratio of the filler 2*a* being changed; an orientation ratio Ro of the filler 2*a* of the sliding layer 2 and a surface roughness (arithmetic average roughness) Ra of the sliding layer 2 were calculated; and the durability was evaluated for comparing the examples and the comparative examples.

Example 1

The sliding layer 2 was formed by using the following materials. The polyimide precursor solution 5 used was U-varnish S made by Ube Industries, Ltd. The U-varnish S is made by using 3,3',4,4'-biphenyltetracarboxylic dianhydride as aromatic tetracarboxylic dianhydride, and paraphenylenediamine as aromatic diamine. The filler 2*a* was made by using fluorophlogopite. Particles of the fluorophlogopite has an aspect ratio of 80 (the average particle diameter is 8 μm and the thickness of each particle is 100 nm). The content of the filler 2*a* to the whole volume of the solid sliding layer 2 was 7 volume percent. The filler-dispersed solution was made by directly adding the filler 2*a* (fluorophlogopite) to the polyimide precursor solution (U-varnish S), then preliminarily mixing the polyimide precursor solution by using a mixer, and then dispersing the filler 2*a* by using a triple roll mill.

Then the inner surface of the base body 1 was coated with the polyimide precursor solution 5 in which the filler 2*a* was dispersed, by using the coating apparatus 20 and the ring coating method such that the thickness of the coating was 77 μm. After the coating, the coating was heated and dried in the heating-and-drying furnace 30 for 300 seconds. In the heating-and-drying furnace 30, the temperature of the high-temperature oil was set at 160° C. After that, the base body 1 was left and dried in the circulating hot air oven having a temperature of 200° C. for 30 minutes, and was then left and baked in another circulating hot air oven having a temperature of 400° C. for 30 minutes, so that the sliding layer 2 was formed. The thickness of the sliding layer 2 formed on the inner surface of the base body 1 was 12 μm.

The surface of the base body 1 was coated with hydrosilyl-base silicone primer (DY39-051 A/B made by Dow Corning Toray Co., Ltd.), and the silicone primer was heated at 200° C. for 5 minutes for curing the silicone primer. Then the outer circumferential surface of the silicone primer was coated with the cross-linked silicone rubber obtained through an additional reaction and having a thickness of 300 μm. The silicone rubber was heated at 200° C. for 30 minutes for curing the silicone rubber, so that the elastic layer 3 was formed. Furthermore, the outer circumferential surface of the elastic layer 3 was covered with the PFA tube having a thickness of 20 μm, as the release layer 4, via silicone adhesive SE1819 CV A/B made by Dow Corning Toray Co., Ltd. The silicone adhesive was heated at 200° C. for 2 minutes for curing the silicone adhesive, so that the fixing belt 201 was formed.

Example 2

Example 2 differs from Example 1 in that the content of the fluorophlogopite, which serves as the filler 2*a*, to the whole volume of the solid sliding layer 2 was 15 volume percent. The other conditions were the same as those of Example 1. The fixing belt 201 of Example 2 was made in this manner.

Example 3

Example 3 differs from Example 1 in that the drying process was performed under a condition that the temperature of the high-temperature oil used in the heating-and-drying furnace 30 was 190° C. The other conditions were the same as those of Example 1. The fixing belt 201 of Example 3 was made in this manner.

Comparative Example 1

Comparative Example 1 differs from Example 1 in that the content of the fluorophlogopite, which serves as the filler 2*a*, to the whole volume of the solid sliding layer 2 was 17 volume percent, and that the drying process was performed under a condition that the temperature of the high-temperature oil used in the heating-and-drying furnace 30 was 100° C. The other conditions were the same as those of Example 1. The fixing belt 201 of Comparative Example 1 was made in this manner.

Comparative Example 2

Comparative Example 2 differs from Example 1 in that the drying process was performed under a condition that the temperature of the high-temperature oil used in the heating-and-drying furnace 30 was 100° C. The other conditions were the same as those of Example 1. The fixing belt 201 of Comparative Example 2 was made in this manner.

Orientation Ratio of Filler

Figure 7:
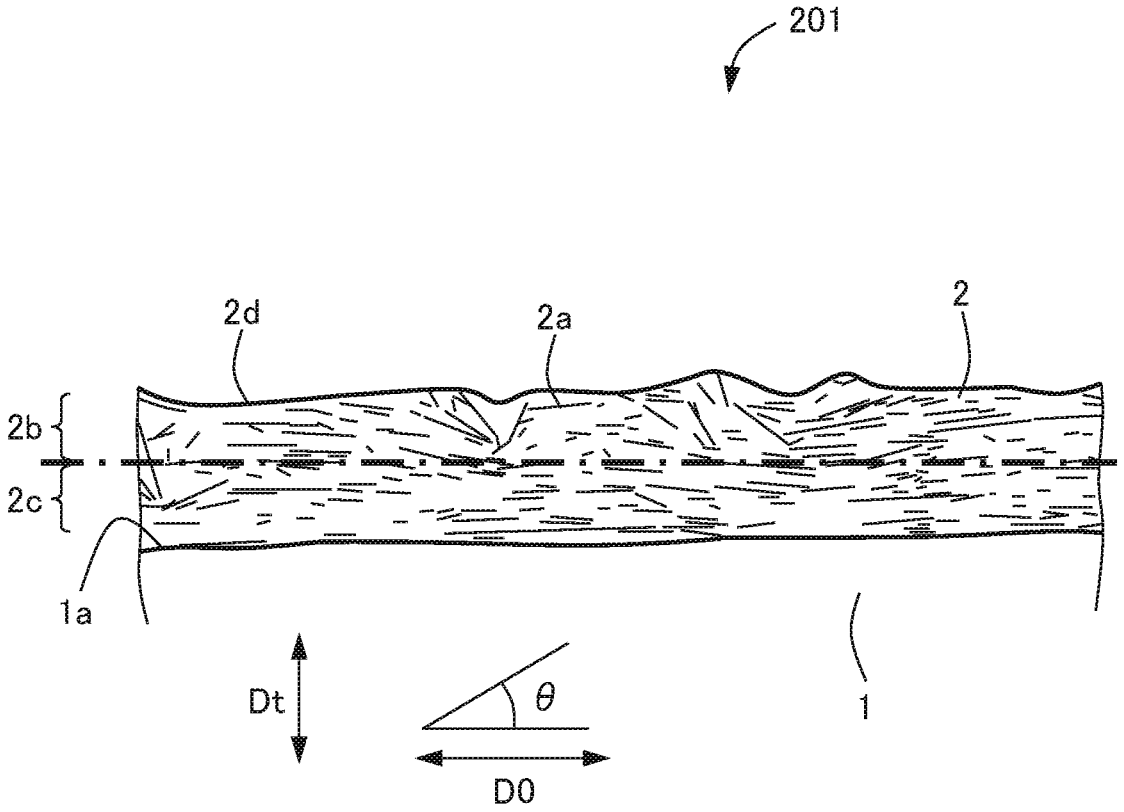
FIG. 7 is a schematic diagram of an SEM image of a cross section of the fixing belt of the first embodiment.

Next, the orientation ratio Ro of the filler 2*a* of the sliding layer 2 will be described. The orientation ration Ro of the filler 2*a* of the sliding layer 2 was calculated as below. As illustrated in FIG. 7, the sliding layer 2 was divided into two areas, an inner-circumferential-surface-side (front side) area 2*b* and a base-body-side area 2*c*, in a thickness direction Dt such that the inner-circumferential-surface-side area 2*b* and the base-body-side area 2*c* have the same thickness. In addition, the orientation ratio Ro of the filler 2*a* of the sliding layer 2 was calculated for each of the inner-circumferential-surface-side area 2*b* and the base-body-side area 2*c*. The orientation ratio Ro of the filler 2*a* of the area, 2*b* or 2*c*, is defined as a ratio of the number of (oriented) filler particles, N1, which are contained in the area and whose angles with respect to a planar direction are within a predetermined angle range, to the number of filler particles, N0, that are contained in the area. Specifically, the fixing belt 201 was cut in the rotational direction (circumferential direction), and then the cross-section milling was performed on the cross section of the sliding layer 2 by using an ion milling system (IM4000PLUS made by Hitachi High-Technologies Corporation). After that, the cross section was observed by using a scanning electron microscope (SEM), and determined as a numerical value by performing an image processing.

FIG. 7 is a schematic diagram of an image of the sliding layer 2, observed by using the SEM after the cross-section milling. The image observed by using the SEM was subjected to binarization, and N0 number of particles of the filler 2*a* was observed by using an optical microscope. Among the particles of the filler 2*a*, particles of the filler 2*a* whose angles θ with respect to a reference direction (planar direction) D0 extending along the inner circumferential surface 1*a* of the base body 1 of the fixing belt 201 satisfy $0 \leq \theta \leq 10°$ or $170° \leq \theta \leq 180°$ were examined, and the number of the particles was determined as N1. Then, the orientation ratio defined as $Ro=(N1/N0)\times 100$ (%) was calculated. Note that the number N0 of particles of the filler 2*a* observed by using an optical microscope is sufficient if the number N0 is about 50.

Table 1 illustrates the orientation ratio Ro calculated in Examples 1 to 3 and Comparative Examples 1 and 2. As illustrated in Table 1, in Examples 1 to 3, the orientation ratio Ro of the inner-circumferential-surface-side area 2*b* is smaller than the orientation ratio Ro of the base-body-side area 2*c*. For example, in Example 1, if the reference direction D0 extends along the inner circumferential surface 1*a* of the base body 1, and in the thickness direction Dt of the sliding layer 2, a first position is defined as the base-body-side area 2*c* and a second position located closer to an inner circumferential surface 2*d* of the sliding layer 2 than the first position is defined as the inner-circumferential-surface-side area 2*b*, the orientation ratio Ro of the filler 2*a* of the base-body-side area 2*c* defined for particles oriented in the reference direction D0 is 91% (first value), and the orientation ratio Ro of the filler 2*a* of the inner-circumferential-surface-side area 2*b* defined for particles oriented in the reference direction D0 is 75% (second value), which is smaller than 91%. That is, an orientation ratio of the filler inclined with respect to a generating line of the fixing belt 201 by a predetermined angle or less is smaller in a first area than in a second area in a cross section of the fixing belt 201 taken along the generating line of the fixing belt 201. The inner-circumferential-surface-side area 2*b*, serving as the first area, is an area formed in an inner-circumferential-surface side of the sliding layer 2, serving as a polyimide layer, in a thickness direction. The base-body-side area 2*c*, serving as the second area, is an area formed in the base-body 1 side of the sliding layer 2 in the thickness direction. In contrast, in Comparative Examples 1 and 2, the orientation ratio Ro of the filler 2*a* of the inner-circumferential-surface-side area 2*b* is almost the same as the orientation ratio Ro of the filler 2*a* of the base-body-side area 2*c*.

was applied with the total pressure applying force of 313.6 N (32 kgf), the pressing roller 206 was rotated such that the moving speed (circumferential speed) of the surface of the pressing roller 206 was kept at 246 mm/sec. In addition, paper sheets with an identical size (A4, long edge feed) were continuously fed in a state where the surface temperature of a sheet passage portion of the fixing belt 201 was adjusted and kept at 170° C. Note that the inner surface of the fixing belt 201 was applied with grease (MOLYKOTE HP-300 made by Dow Corning Toray Co., Ltd.), as lubricant, by 1.2 g.

Next, the evaluation method will be described. In the sliding property evaluation, if any abnormal sound of the fixing belt 201 did not occur at the minimum speed 120 mm/s of the apparatus and the load torque was equal to or smaller than 800 mN·m, a symbol "o" was given; if not, a symbol "×" was given. The abnormal sound of the fixing belt 201 is caused by self-induced vibration of the fixing belt 201, which is caused by the occurrence of stick slip. The sliding property was evaluated for the fixing belt 201 in the initial state before the durability test was performed, and for the fixing belt 201 in the state after the durability test was performed. In the durability test, 500,000 paper sheets GF-C081 (having 80 g/m$^2$ and made by Nippon Paper Industries Co., Ltd.) were fed to the fixing apparatus. Table 1 illustrates the result.

TABLE 1

| | FILLER CONTENT (vol %) | DRYING TEMPERATURE (° C) | ORIENTATION RATIO Ro(%) INNER-CIRCUMFERENTIAL-SURFACE SIDE | | ORIENTATION RATIO Ro(%) BASE-BODY SIDE | ROUGHNESS Ra (μm) | ABNORMAL SOUND AND TORQUE INITIAL STATE | ABNORMAL SOUND AND TORQUE STATE AFTER DURABILITY TEST |
|---|---|---|---|---|---|---|---|---|
| EXAMPLE 1 | 7 | 160 | 75 | < | 91 | 0.21 | ○ | ○ |
| EXAMPLE 2 | 15 | 160 | 81 | < | 96 | 0.41 | ○ | ○ |
| EXAMPLE 3 | 7 | 190 | 63 | < | 90 | 0.42 | ○ | ○ |
| COMPARATIVE EXAMPLE 1 | 17 | 100 | 96 | ≈ | 95 | 0.23 | ○ | x |
| COMPARATIVE EXAMPLE 2 | 7 | 100 | 93 | ≈ | 93 | 0.10 | x | — |

Surface Roughness of Sliding Layer

A surface roughness Ra of the inner circumferential surface of the sliding layer 2 was measured as an arithmetic average roughness Ra (μm, JIS B0601) by using a surface-roughness measuring instrument (SURFCORDER made by Kosaka Laboratory Ltd.). As the measurement conditions, the evaluation length was set at 4 mm, the cutoff value was set at 0.8 mm, and the measuring speed was set at 0.1 mm/s. Table 1 illustrates the surface roughness Ra calculated in Examples 1 to 3 and Comparative Examples 1 and 2.

Note that in Examples 1 to 3, the inner circumferential surface 2*d* of the sliding layer 2 has a plurality of Benard cells whose average diameter is equal to or larger than 50 μm and smaller than 200 μm, and the arithmetic average roughness of the inner circumferential surface 2*d* is equal to or larger than 0.20 μm and equal to or smaller than 0.50 μm.

Durability Evaluation

Figure 2:
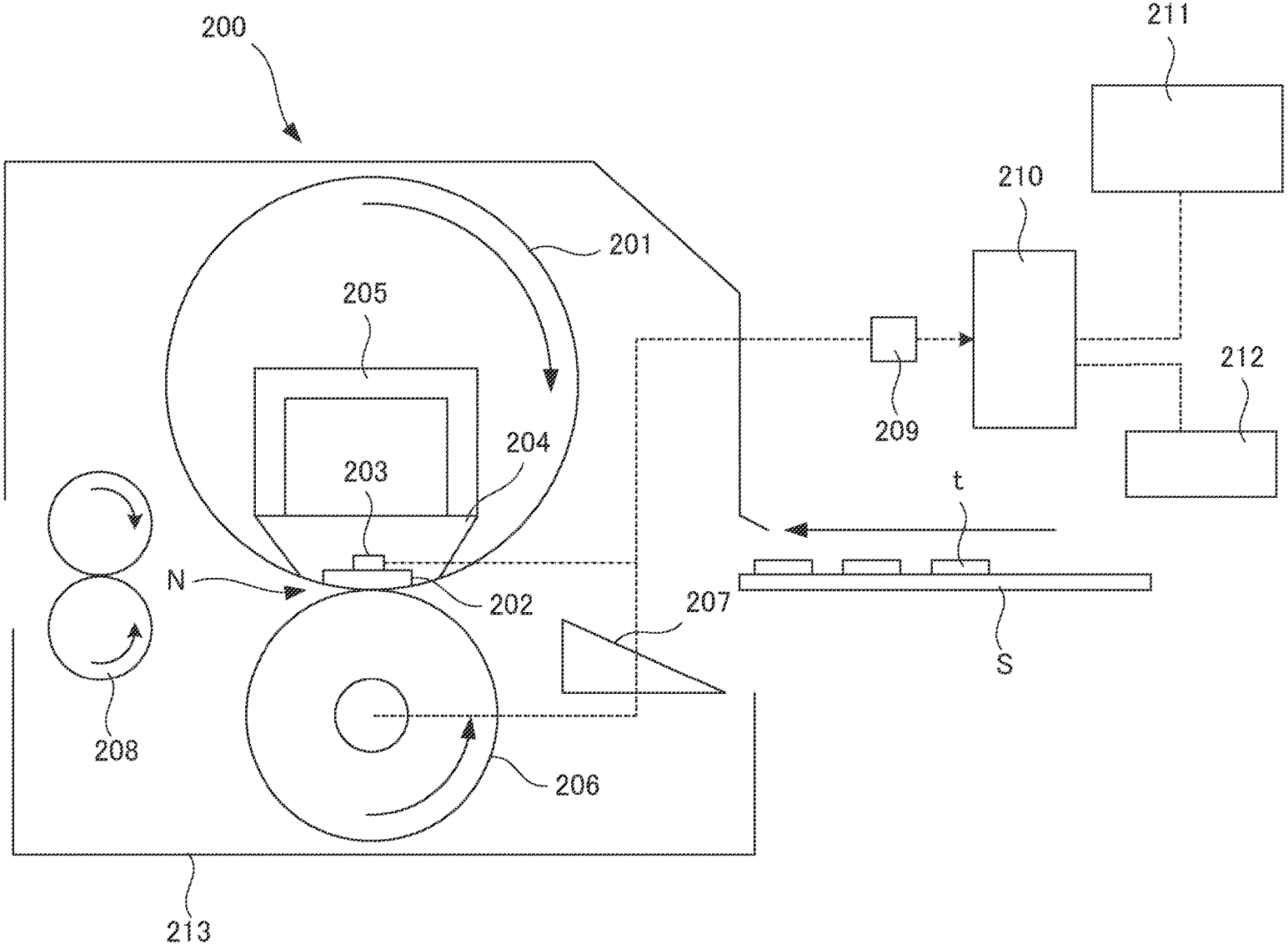
FIG. 2 is a cross-sectional view illustrating a schematic configuration of a fixing apparatus of the first embodiment.

The durability evaluation of the fixing belt 201 was performed on the fixing belt 201 of each of Examples 1 to 3 and Comparative Examples 1 and 2, attached to the belt-heating fixing apparatus 200 illustrated in FIG. 2. In addition, in the durability evaluation, in a state where one end portion of the fixing belt 201 was applied with a pressure applying force of about 156.8 N, that is, the fixing belt 201

As illustrated in Table 1, when the orientation ratio Ro of the filler 2*a* of the inner-circumferential-surface-side area 2*b* of the sliding layer 2 was smaller than the orientation ratio Ro of the filler 2*a* of the base-body-side area 2*c* of the sliding layer 2 in the thickness direction Dt of the sliding layer 2, the abnormal sound caused by the occurrence of stick slip and the torque stability obtained after the durability test were acceptable. This is because of the following reasons.

If the temperature for drying the coating of the polyimide precursor solution 5 (or for vaporizing the solvent), which has been applied onto the inner surface of the base body 1, is set high, the orientation ratio Ro of the filler 2*a* of the inner-circumferential-surface-side area 2*b* becomes smaller than the orientation ratio Ro of the filler 2*a* of the base-body-side area 2*c*. This is because the temperature gradient of the coating increases in the thickness direction Dt and the Benard convection occurs in the solvent. If the Benard convection occurs, the particles of the filler 2*a* that have been oriented in the reference direction (planar direction) D0 are whirled up along the Benard convection. Thus, in Examples 1 to 3, the orientation ratio Ro of the filler 2*a* of the inner-circumferential-surface-side area 2*b* of the sliding layer 2 decreases through this phenomenon, so that a desired surface roughness Ra can be obtained with a proper content of the filler 2*a*. Therefore, the abnormal sound and the torque up, which is caused by the lowered wear resistance strength, can be suppressed in its service life.

In contrast, in Comparative Example 1, the surface roughness Ra was adjusted so as to have a proper value, by increasing the content of the filler 2*a* in a state where the orientation ratio Ro of the filler 2*a* of the inner-circumferential-surface-side area 2*b* of the sliding layer 2 was almost the same as that of the base-body-side area 2*c*. However, since the content of the filler 2*a* was increased, the wear resistance strength of the sliding layer 2 was lowered. As a result, the sliding layer 2 was excessively worn in the durability test, so that the torque up occurred. In Comparative Example 2, since the orientation ratio Ro of the filler 2*a* of the inner-circumferential-surface-side area 2*b* was as high as the orientation ratio Ro of the filler 2*a* of the base-body-side area 2*c* even though the content of the filler 2*a* was the same as that of Example 1, the surface roughness Ra that sufficiently suppresses the abnormal sound was not obtained.

As described above, if the particles of the filler 2*a* are optimally oriented such that the orientation ratio Ro of the filler 2*a* of the inner-circumferential-surface-side area 2*b* of the sliding layer 2 is smaller than the orientation ratio Ro of the filler 2*a* of the base-body-side area 2*c*, the effective surface roughness Ra of the inner circumferential surface 2*d* of the sliding layer 2 is obtained. In addition, if the particles of the filler 2*a* are optimally oriented, the wear resistance of the fixing belt 201 increases in the rotational direction of the fixing belt 201. Therefore, the sliding layer 2 of the fixing belt 201 can suppress the torque up and the stick slip in its service life.

As described above, in the fixing belt 201 of the present embodiment, the orientation ratio Ro of the filler 2*a* of the inner-circumferential-surface-side area 2*b* is made smaller than the orientation ratio Ro of the filler 2*a* of the base-body-side area 2*c*. As a result, the effective surface roughness Ra of the inner circumferential surface 2*d* of the sliding layer 2 is obtained, and the wear resistance of the fixing belt 201 increases in the rotational direction of the fixing belt 201. Therefore, the sliding layer 2 of the fixing belt 201 can suppress the torque up and the stick slip in its service life, and the wear resistance of the fixing belt 201 can be increased.

Second Embodiment

Next, a second embodiment of the present invention will be described in detail with reference to FIG. 8. In the present embodiment, the wear resistance strength is increased by causing the size of the Benard cells of the sliding layer 2 to fall into a proper range. Since the other configuration of the second embodiment is the same as that of the first embodiment, a component identical to that of the first embodiment is given an identical symbol and the detailed description thereof will be omitted.

First, a Benard cell 6 will be described. As illustrated in FIG. 8, in the sliding layer 2, the Benard convection (indicated by arrows in FIG. 8) occurs in the drying process, and the Benard cell 6 is formed. The Benard cell 6 is left even after the sliding layer 2 is formed. The diameter of the Benard cell 6 viewed from the inner circumferential surface 2*d* side of the sliding layer 2 is defined as a Benard-cell diameter d1. In the present embodiment, the Benard cell 6 is formed in the drying process, which is performed for forming the sliding layer 2, by producing a temperature difference of the polyimide precursor solution 5 in the thickness direction of the polyimide precursor solution 5. Specifically, in the drying process, air is sent toward the inner side of the base body 1 so that the temperature of the base body side of the polyimide precursor solution 5 becomes higher than the ambient temperature of the inner side of the polyimide precursor solution 5.

EXAMPLES AND COMPARATIVE EXAMPLES

Hereinafter, examples and comparative examples will be described. In the examples and the comparative examples, the sliding layer 2 was made, with the Benard-cell diameter d1 being changed. In the examples and the comparative examples, the surface roughness Ra of the sliding layer 2 was calculated, and the durability was evaluated for comparing the examples and the comparative examples.

Example 4

The content of the filler 2*a* was set at 11 volume percent, and the Benard-cell diameter d1 was set at 50 μm. The other conditions were the same as those of Example 1. The fixing belt 201 of Example 4 was made in this manner.

Example 5

The content of the filler 2*a* was set at 11 volume percent, and the Benard-cell diameter d1 was set at 100 μm. The other conditions were the same as those of Example 1. The fixing belt 201 of Example 5 was made in this manner.

Example 6

The content of the filler 2*a* was set at 11 volume percent, and the Benard-cell diameter d1 was set at 150 μm. The other conditions were the same as those of Example 1. The fixing belt 201 of Example 6 was made in this manner.

Example 7

The content of the filler 2*a* was set at 11 volume percent, and the Benard-cell diameter d1 was set at 200 μm. The other conditions were the same as those of Example 1. The fixing belt 201 of Example 7 was made in this manner.

Example 8

The content of the filler 2*a* was set at 11 volume percent, and the Benard-cell diameter d1 was set at 250 μm. The other conditions were the same as those of Example 1. The fixing belt 201 of Example 8 was made in this manner.

Comparative Example 3

The filler 2*a* was not contained in the polyimide precursor solution 5. The other conditions were the same as those of Example 1. The fixing belt 201 of Comparative Example 3 was made in this manner.

Comparative Example 4

The content of the filler 2*a* was set at 5.0 wt %, and the Benard-cell diameter d1 was set at 25 μm. The other conditions were the same as those of Example 1. The fixing belt 201 of Comparative Example 4 was made in this manner.

Comparative Example 5

The content of the filler 2*a* was set at 20.0 wt %, and the Benard-cell diameter d1 was set at 25 μm. The other conditions were the same as those of Example 1. The fixing belt 201 of Comparative Example 5 was made in this manner.

Comparative Example 6

The content of the filler 2*a* was set at 20.0 wt %, and the Benard-cell diameter d1 was set at 250 μm. The other conditions were the same as those of Example 1. The fixing belt 201 of Comparative Example 6 was made in this manner.

Next, the surface roughness Ra will be described. The surface roughness Ra depends on the size of the Benard cell 6 and the amount of addition of the filler 2*a*. If the amount of addition of the filler 2*a* increases, the diameter of the Benard cell 6 decreases. That is, if the frequency of projection of the edge portions of the Benard cells 6 increases, the surface roughness Ra increases.

heating fixing apparatus 200 illustrated in FIG. 2. The fixing apparatus 200 was incorporated into a full-color copying machine, iR ADVANCE C5051 made by Canon Inc. The pressure applying force was set at 320 N, the fixing temperature (fixing-belt surface temperature) was set at 170° C., and the process speed was set at 320 mm/sec. Note that the inner surface of the fixing belt 201 was applied with grease (HP300 made by Dow Corning Asia Co., Ltd.), as lubricant, by 1.2 g.

Next, the evaluation method will be described. The method of evaluating the sliding property is the same as that of the first embodiment. For evaluating the fixing property, paper sheets (GFC-081 made by Nippon Paper Industries Co., Ltd. and having 80 g/m$^2$) were used, an image was formed on the paper sheets such that the amount of toner on each paper sheet was 0.9 mg/cm$^2$. Then the image formed on each paper sheet was bent. If the width of toner that peeled off when the paper sheet was bent was smaller than 1 mm, a symbol "o" was given. If the width of toner that peeled off was equal to or larger than 1 mm, a symbol "x" was given. Table 2 illustrates the result.

TABLE 2

| | FILLER CONTENT | BENARD-CELL DIAMETER d1 (μm) | ROUGHNESS Ra (μm) | SLIDING PROPERTY INITIAL STATE | SLIDING PROPERTY STATE AFTER DURABILITY TEST | FIXING PROPERTY |
|---|---|---|---|---|---|---|
| EXAMPLE 4 | 11.0 (vol %) | 50 | 0.50 | ○ | ○ | ○ |
| EXAMPLE 5 | 11.0 (vol %) | 100 | 0.44 | ○ | ○ | ○ |
| EXAMPLE 6 | 11.0 (vol %) | 150 | 0.36 | ○ | ○ | ○ |
| EXAMPLE 7 | 11.0 (vol %) | 200 | 0.28 | ○ | ○ | ○ |
| EXAMPLE 8 | 11.0 (vol %) | 250 | 0.20 | ○ | ○ | ○ |
| COMPARATIVE EXAMPLE 3 | — | — | 0.05 | x | x | ○ ○ |
| COMPARATIVE EXAMPLE 4 | 5.0 (wt %) | 25 | 0.18 | x | x | ○ |
| COMPARATIVE EXAMPLE 5 | 20.0 (wt %) | 25 | 0.80 | ○ ○ | x | x |
| COMPARATIVE EXAMPLE 6 | 20.0 (wt %) | 250 | 0.50 | ○ | x | ○ |

Figure 8:
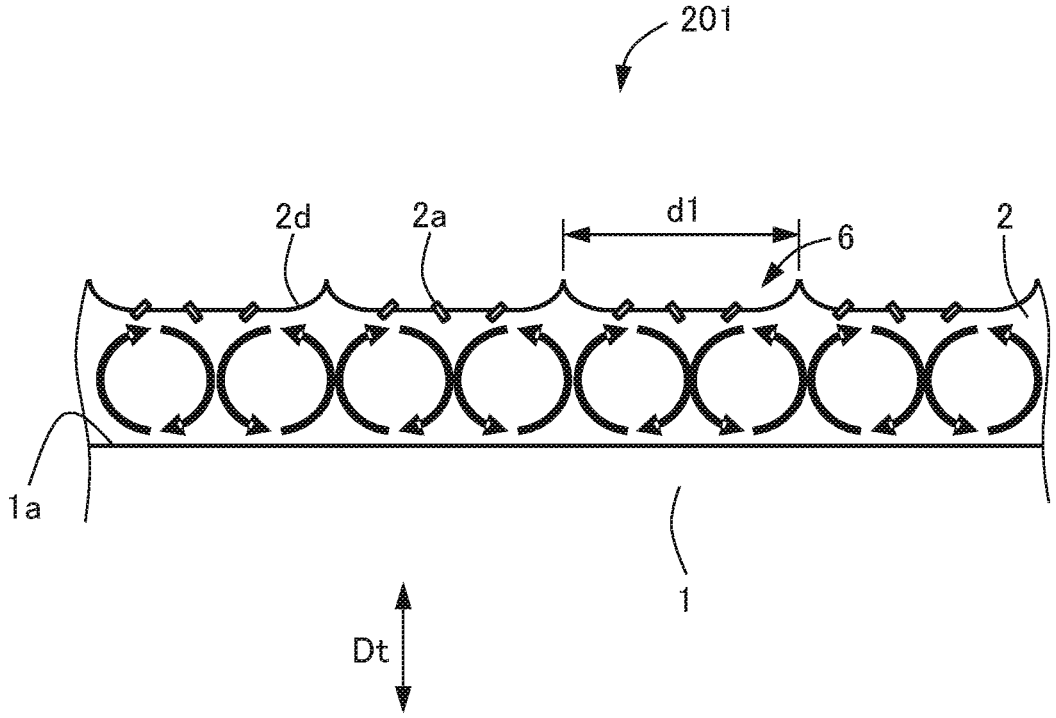
FIG. 8 is a schematic diagram of Benard cells viewed in a cross section of a fixing belt of a second embodiment.

FIG. 8 is a schematic diagram illustrating a state of the filler 2*a* of the sliding layer 2 that has the Benard cell 6. If the Benard cell 6 is formed when the polyimide precursor solution 5 of the sliding layer 2 is imidized, liquid circulation as indicated by arrows occurs in the sliding layer 2. With the liquid circulation, (i) the particles of the filler 2*a* are whirled up toward the surface of the polyimide precursor solution 5 and fixed, and (ii) a portion of the sliding layer 2 that corresponds to an edge portion of the Benard cell 6 projects. As a result, the surface roughness Ra increases. Thus, if the amount of addition of the filler 2*a* increases, the amount of the filler 2*a* that is whirled up increases (described above (i)), which increases the surface roughness Ra. In addition, if the amount of addition of the filler 2*a* increases, the size of the Benard cell 6 decreases. As a result, the frequency of projections of the edge portions of the Benard cells 6 increases, so that the surface roughness Ra increases. Table 2 illustrates the surface roughness Ra obtained from the relationship between the shape of the Benard cell 6 and the content of the filler.

Durability Evaluation

The durability evaluation of the fixing belt 201 was performed on the fixing belt 201 of each of Examples 4 to 8 and Comparative Examples 3 to 6, attached to the belt- Note that in Examples 4 to 8, the inner circumferential surface 2*d* of the sliding layer 2 has a plurality of Benard cells 6 whose average diameter is equal to or larger than 50 μm and smaller than 250 μm, and the surface roughness (i.e., arithmetic average roughness) Ra of the inner circumferential surface 2*d* is equal to or larger than 0.20 μm and equal to or smaller than 0.50 μm. In Examples 4 to 8, the sliding property and the fixing property were both acceptable. As to the sliding property, the initial sliding property was acceptable because the initial surface roughness was sufficient. In addition, the sliding property obtained after the durability test was also acceptable because the less amount of the filler 2*a* suppressed the sliding layer 2 from being worn in the durability test. Thus, since the shape of the Benard cell 6 was determined in this manner, the desired surface roughness Ra was able to be efficiently obtained by using the less amount of the filler 2*a*. Consequently, the sliding property was acceptable in a period of time from the start to the end of the durability test, and even after the durability test. As to the fixing property, since the surface roughness Ra is smaller than a predetermined value, it was confirmed that the fixing property does not deteriorate.

In contrast, in Comparative Example 3, since the filler 2*a* was not contained in the sliding layer 2, the surface roughness Ra had a lower value and the fixing property was acceptable. However, since the surface roughness Ra was insufficient, the sliding property was not acceptable in a period of time from the start to the end of the durability test. In Comparative Example 4, even though the filler 2*a* was contained in the sliding layer 2 and the Benard cell 6 had a smaller diameter, the surface roughness Ra was insufficient as in Comparative Example 3, and the sliding property was not acceptable in a period of time from the start to the end of the durability test.

In Comparative Example 5, since the filler 2*a* was excessively contained in the sliding layer 2, the surface roughness Ra had a high value. Thus, even though the initial sliding property was acceptable, the wear of the inner surface of the sliding layer 2 increased in the durability test in which the paper sheets were fed. Thus, the sliding property obtained after the durability test was not acceptable. In addition, since the initial surface roughness Ra was excessively high, the fixing property was also not acceptable. In Comparative Example 6, since the Benard cell 6 had a larger diameter, the surface roughness Ra had a lower value, and the fixing property was acceptable. However, since the filler 2*a* was excessively contained in the sliding layer 2, the wear of the inner surface of the sliding layer 2 increased, and the sliding property obtained after the durability test became unacceptable. Thus, with the diameter of the Benard cell 6 and the surface roughness Ra as described in Examples 4 to 8, the sliding property and the fixing property of the fixing belt 201 were acceptable in a period of time from the start to the end of the durability test, and even after the durability test.

As described above, in the fixing belt 201 of the present embodiment, the average diameter of the B enard cells 6 of the inner circumferential surface 2*d* of the sliding layer 2 is equal to or larger than 50 μm and smaller than 250 μm, and the surface roughness Ra of the inner circumferential surface 2*d* satisfies 0.20 μm≤Ra≤0.50 μm. As a result, the effective surface roughness Ra of the inner circumferential surface 2*d* of the sliding layer 2 is obtained, and the wear resistance of the fixing belt 201 increases in the rotational direction of the fixing belt 201. Therefore, the sliding layer 2 of the fixing belt 201 can suppress the torque up and the stick slip in its service life, and the wear resistance strength of the fixing belt 201 can be increased.

Note that the fixing belt 201 of the present embodiment may have the feature of the fixing belt 201 of the first embodiment. That is, in the fixing belt 201 of the present embodiment, the orientation ratio Ro of the filler 2*a* of the inner-circumferential-surface-side area 2*b* may be smaller than the orientation ratio Ro of the filler 2*a* of the base-body-side area 2*c*.

Third Embodiment

Next, a third embodiment of the present invention will be described in detail. In the present embodiment, the wear resistance strength is increased by causing the difference in temperature between the inner side and the outer side of the base body 1 to be kept within a proper range in the drying process. Since the other configuration of the third embodiment is the same as that of the first embodiment, a component identical to that of the first embodiment is given an identical symbol and the detailed description thereof will be omitted.

In the present embodiment, a method of manufacturing the fixing belt 201 at least includes a coating process (see Step S2 of FIG. 4) and a drying process (see Step S4 of FIG. 4), which are performed when the sliding layer 2 is formed. The coating process is a process in which the inner circumferential surface la of the base body 1 is coated with the polyimide precursor solution 5. In the polyimide precursor solution 5, the precursor of the sliding layer 2 and the filler 2*a* are dispersed in the solvent. The drying process is a process in which the solvent of the polyimide precursor solution 5, which has been applied onto the inner circumferential surface 1*a* of the base body 1, is vaporized.

In the present embodiment, the Benard cell 6 is formed in the drying process, which is performed for forming the sliding layer 2, by producing a temperature difference of the polyimide precursor solution 5 in the thickness direction Dt of the polyimide precursor solution 5. Specifically, the air is sent toward the inner side of the base body 1 so that the temperature of the base body side of the polyimide precursor solution 5 becomes higher than the ambient temperature of the inner side of the polyimide precursor solution 5.

In the present embodiment, a temperature X of the base-body side of the polyimide precursor solution 5 and an ambient temperature Y of the inner surface side of the polyimide precursor solution 5 satisfy the relationship of 10° C.≤X−Y≤30° C. If the relationship of X−Y≥10° C. is satisfied, the Benard cell 6 is formed when the polyimide precursor solution 5 is dried, and liquid circulation as indicated by arrows of FIG. 8 occurs in the sliding layer 2. With the liquid circulation, the particles of the filler 2*a* are whirled up toward the surface of the polyimide precursor solution 5 and fixed, and a portion of the sliding layer 2 that corresponds to an edge portion of the Benard cell 6 projects. As a result, the surface roughness Ra increases. However, if the relationship of X−Y<10° C. is satisfied, the Benard cell 6 may not be formed suitably, and thus the surface roughness Ra may not have a desired value. If the relationship of X−Y>30° C. is satisfied, projections of the sliding layer 2 caused by the Benard cell 6 may increase excessively, and thus the surface roughness Ra may have an excessive value. As a result, the contact thermal resistance between the fixing belt 201 and the fixing heater 202, which is disposed inside the fixing belt 201, may increase, possibly causing insufficient heat transfer property.

EXAMPLES AND COMPARATIVE EXAMPLES

Hereinafter, examples and comparative examples will be described. In the examples and the comparative examples, the sliding layer 2 was made, with the base-body-side temperature X and the inner-circumferential-surface-side temperature Y being changed. In the examples and the comparative examples, the surface roughness Ra of the sliding layer 2 was calculated, and the durability was evaluated for comparing the examples and the comparative examples.

Example 9

The base-body-side temperature X was set at 160° C., and the inner-circumferential-surface-side temperature Y was set at 140° C. The other conditions were the same as those of Example 1. The fixing belt 201 of Example 9 was made in this manner.

Example 10

The base-body-side temperature X was set at 160° C., and the inner-circumferential-surface-side temperature Y was set at 150° C. The other conditions were the same as those of Example 1. The fixing belt 201 of Example 10 was made in this manner.

Example 11

The base-body-side temperature X was set at 190° C., and the inner-circumferential-surface-side temperature Y was set at 160° C. The other conditions were the same as those of Example 1. The fixing belt 201 of Example 11 was made in this manner.

Comparative Example 7

The base-body-side temperature X was set at 100° C., and the inner-circumferential-surface-side temperature Y was set at 95° C. The other conditions were the same as those of Example 1. The fixing belt 201 of Comparative Example 7 was made in this manner.

Comparative Example 8

The base-body-side temperature X was set at 190° C., and the inner-circumferential-surface-side temperature Y was set at 150° C. The other conditions were the same as those of Example 1. The fixing belt 201 of Comparative Example 8 was made in this manner.

The durability evaluation of the fixing belt 201 was performed by using the same evaluation method as that of the first and the second embodiments. Table 3 illustrates the result of the durability evaluation performed in Examples 9 to 11 and Comparative Examples 7 and 8.

TABLE 3

| | DRYING TEMPERATURE (°C) | | | | ABNORMAL SOUND AND TORQUE | | |
|---|---|---|---|---|---|---|---|
| | BASE-BODY SIDE X | INNER-CIRCUM-FERENTIAL-SURFACE SIDE Y | X-Y | ROUGHNESS Ra (μm) | INITIAL STATE | STATE AFTER DURABILITY TEST | FIXING PROPERTY |
| EXAMPLE 9 | 160 | 140 | 20 | 0.21 | ○ | ○ | ○ |
| EXAMPLE 10 | 160 | 150 | 10 | 0.41 | ○ | ○ | ○ |
| EXAMPLE 11 | 190 | 160 | 30 | 0.50 | ○ | ○ | ○ |
| COMPARATIVE EXAMPLE 7 | 100 | 95 | 5 | 0.06 | x | x | ○ |
| COMPARATIVE EXAMPLE 8 | 190 | 150 | 40 | 0.55 | ○ | ○ | x |

In Examples 9 to 11, the base-body-side temperature X and the inner-circumferential-surface-side temperature Y satisfy the relationship of 10° C.≤X−Y≤30° C. For example, in Example 9, the temperature of the outer circumferential surface of the base body 1 is a first temperature (160° C.), and the ambient temperature of the inner-circumferential-surface side of the sliding layer 2 is a second temperature (140° C.), which is lower than the first temperature. In this case, the difference between the first temperature and the second temperature is equal to or larger than 10° C. and equal to or smaller than 30° C.

As a result, in Examples 9 to 11, the sliding property and the fixing property were both acceptable. As to the sliding property, the initial sliding property was acceptable because the initial surface roughness Ra was sufficient. In addition, the sliding property obtained after the durability test was also acceptable because the less amount of the filler 2*a* suppressed the sliding layer 2 from being worn in the durability test. As described above, after the base body 1 is coated with the polyimide precursor solution 5, the organic polar solvent is vaporized under the temperature conditions. In Examples 9 to 11, the temperature conditions were determined as described above, so that the Benard cell 6 was suitably formed and the effective surface roughness Ra was obtained with the less amount of the filler 2*a*. Thus, the sliding property was acceptable in a period of time from the start to the end of the durability test, and even after the durability test. As to the fixing property, since the surface roughness Ra is smaller than a predetermined value, it was confirmed that the fixing property does not deteriorate.

In contrast, in Comparative Example 7, since the size of the Benard cell 6 was smaller, the fixing property was acceptable. However, since the surface roughness Ra was insufficient, the sliding property was not acceptable in a period of time from the start to the end of the durability test. In Comparative Example 8, since the size of the Benard cell 6 was larger, the surface roughness Ra was increased, and the initial sliding property and the sliding property obtained after the durability test (in which the paper sheets were fed) were acceptable. However, since the initial surface roughness Ra was excessively high, the fixing property was not acceptable.

As described above, after the base body 1 was coated with the polyimide precursor solution 5, the organic polar solvent was vaporized under the temperature conditions. The temperature conditions were determined as described in Examples 9 to 11. As a result, the Benard cell 6 was formed and the desired surface roughness Ra was obtained. Consequently, the sliding property and the fixing property of the fixing belt 201 were acceptable in a period of time from the start to the end of the durability test, and even after the durability test.

As described above, in the fixing belt 201 of the present embodiment, the base-body-side temperature X and the inner-circumferential-surface-side temperature Y satisfy the relationship of 10° C.≤X−Y≤30° C. As a result, the effective surface roughness Ra of the inner circumferential surface 2*d* of the sliding layer 2 is obtained, and the wear resistance of the fixing belt 201 increases in the rotational direction of the fixing belt 201. Therefore, the sliding layer 2 of the fixing belt 201 can suppress the torque up and the stick slip in its service life, and the wear resistance strength of the fixing belt 201 can be increased.

Note that the fixing belt 201 manufactured by using the manufacturing method of the present embodiment may have the feature of the fixing belt 201 of the first embodiment. That is, in the fixing belt 201 manufactured by using the manufacturing method of the present embodiment, the orientation ratio Ro of the filler 2*a* of the inner-circumferential-surface-side area 2*b* may be made smaller than the orientation ratio Ro of the filler 2*a* of the base-body-side area 2*c*. In another case, the fixing belt 201 manufactured by using the manufacturing method of the present embodiment may have the feature of the fixing belt 201 of the second embodiment. That is, in the fixing belt 201 manufactured by using the manufacturing method of the present embodiment, the average diameter of the Benard cells 6 may be equal to or larger than 50 μm and smaller than 200 μm.

Fourth Embodiment

Figure 9A:
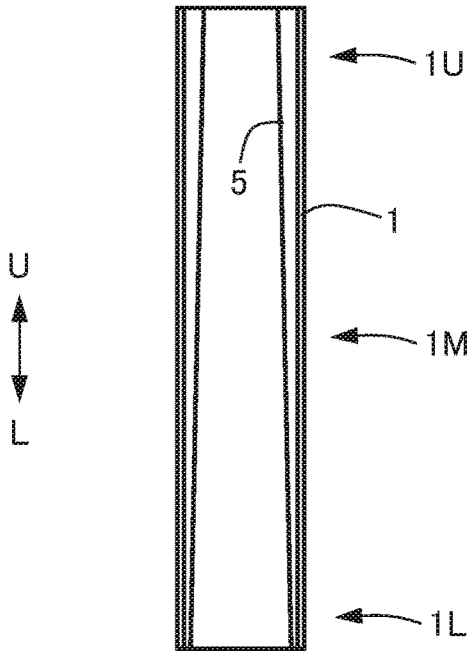
FIG. 9A is a longitudinal-sectional view of a fixing belt of a fourth embodiment, on which a coating process has been performed and a drying process has still not been performed.
Figure 9B:
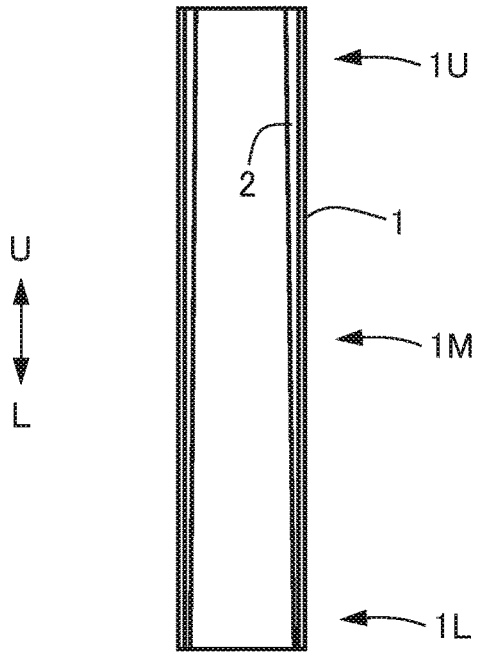
FIG. 9B is a longitudinal-sectional view of the fixing belt of the fourth embodiment, on which a baking process has been performed.

Next, a fourth embodiment of the present invention will be described in detail with reference to FIGS. 9A and 9B. In the present embodiment, the wear resistance strength is increased by causing the thickness of each portion of coating of the polyimide precursor solution 5 to fall into a proper range in the drying process. Since the other configuration of the fourth embodiment is the same as that of the first embodiment, a component identical to that of the first embodiment is given an identical symbol and the detailed description thereof will be omitted.

In the drying process in which the sliding layer 2 is formed, the air flows through the inner-circumferential-surface side of the base body 1. Since the air with room temperature flows, the temperature of an air-inlet-side portion 1U of the base body 1 becomes lower than the temperature of an air-outlet-side portion 1L of the base body 1, as illustrated in FIG. 9A. As a result, a temperature difference is produced in the longitudinal direction (up-and-down direction) of the base body 1. In the drying process, the surface roughness Ra of each portion (illustrated in FIG. 9B) of the sliding layer 2 is affected by the temperature at which the organic polar solvent is reduced from about 85 volume percent to less than about 30 volume percent, and by the thickness of each portion (illustrated in FIG. 9A) of the polyimide precursor solution 5.

In the present embodiment, a third position is defined in the up-and-down direction of the base body 1. The thickness of a portion of the polyimide precursor solution 5 located at the third position is defined as a third value. In addition, a fourth position located above the third position is defined. The thickness of a portion of the polyimide precursor solution 5 located at the fourth position is defined as a fourth value thicker than the third value. That is, the base body 1 is coated with the polyimide precursor solution 5 such that the thickness of the polyimide precursor solution 5 is gradually decreased from the upper side toward the lower side in the direction in which the air flows. In addition, in the drying process, the solvent is vaporized such that the temperature of the outer circumferential surface of the portion of the base body 1 located at the lower third position is kept at a third temperature, and that the temperature of the outer circumferential surface of the portion of the base body 1 located at the upper fourth position is kept at a fourth temperature lower than the third temperature.

In this manner, the difference between the surface roughness Ra at the third position and the surface roughness Ra at the fourth position is reduced, so that the surface roughness Ra is uniformed in the whole of the base body 1. Note that in the present embodiment, as in the third embodiment, the base-body-side temperature X and the inner-circumferential-surface-side temperature Y satisfy the relationship of $10° C. \leq X-Y \leq 30° C$. As a result, the surface roughness Ra is uniformed in a proper range.

EXAMPLES AND COMPARATIVE EXAMPLES

Hereinafter, examples and comparative examples will be described. In the examples and the comparative examples, the sliding layer 2 was made, with the thickness of the polyimide precursor solution 5 being changed in the coating process at the air-inlet-side portion 1U, an intermediate portion 1M, and the air-outlet-side portion 1L of the base body 1. In the examples and the comparative examples, the surface roughness Ra of the sliding layer 2 was calculated, and the durability was evaluated for comparing the examples and the comparative examples. In the following examples and comparative examples, the base-body-side temperature X and the inner-circumferential-surface-side temperature Y satisfy the relationship of $10° C. \leq X-Y \leq 30° C$.

Example 12

In the coating process, the thickness of coating of the polyimide precursor solution 5 was made larger on the air-inlet side of the air passage of the heating-and-drying furnace 30, and smaller on the air-outlet side. In the present embodiment, the thickness of coating of the polyimide precursor solution 5 was set at 90 μm at the air-inlet-side portion 1U of the base body 1, 77 μm at the intermediate portion 1M, and 64 μm at the air-outlet-side portion 1L. The other conditions were the same as those of Example 1. The fixing belt 201 of Example 12 was made in this manner.

Example 13

The thickness of coating of the polyimide precursor solution 5 was set at 90 μm at the air-inlet-side portion 1U of the base body 1, 77 μm at the intermediate portion 1M, and 58 μm at the air-outlet-side portion 1L. The other conditions were the same as those of Example 1. The fixing belt 201 of Example 13 was made in this manner.

Example 14

The thickness of coating of the polyimide precursor solution 5 was set at 83 μm at the air-inlet-side portion 1U of the base body 1, 77 μm at the intermediate portion 1M, and 58 μm at the air-outlet-side portion 1L. The other conditions were the same as those of Example 1. The fixing belt 201 of Example 14 was made in this manner.

Comparative Example 9

The thickness of coating of the polyimide precursor solution 5 was set at 77 μm at the air-inlet-side portion 1U of the base body 1, 77 μm at the intermediate portion 1M, and 77 μm at the air-outlet-side portion 1L. The other conditions were the same as those of Example 1. The fixing belt 201 of Comparative Example 9 was made in this manner.

Comparative Example 10

The thickness of coating of the polyimide precursor solution 5 was set at 64 μm at the air-inlet-side portion 1U of the base body 1, 77 μm at the intermediate portion 1M, and 90 μm at the air-outlet-side portion 1L. The other conditions were the same as those of Example 1. The fixing belt 201 of Comparative Example 10 was made in this manner.

In Examples 12 to 14 and Comparative Examples 9 and 10, the surface temperature and the surface roughness Ra at the air-inlet-side portion 1U, the intermediate portion 1M, and the air-outlet-side portion 1L of the base body 1 were measured when 60 seconds had elapsed since the base body 1 was put in the heating-and-drying furnace 30. Table 4 illustrates the result.

TABLE 4

| | SURFACE TEMPERATURE (° C) | | | THICKNESS OF SOLUTION (μm) | | | ROUGHNESS Ra(μm) | | |
|---|---|---|---|---|---|---|---|---|---|
| | AIR INLET SIDE | INTERME-DIATE PORTION | AIR OUTLET SIDE | AIR INLET SIDE | INTERME-DIATE PORTION | AIR OUTLET SIDE | AIR INLET SIDE | INTERME-DIATE PORTION | AIR OUTLET SIDE |
| EXAMPLE 12 | 115 | 135 | 153 | 90 | 77 | 64 | 0.30 | 0.29 | 0.31 |
| EXAMPLE 13 | 117 | 138 | 161 | 90 | 77 | 58 | 0.30 | 0.31 | 0.33 |
| EXAMPLE 14 | 114 | 129 | 145 | 83 | 77 | 58 | 0.27 | 0.28 | 0.27 |
| COMPARATIVE EXAMPLE 9 | 116 | 133 | 152 | 77 | 77 | 77 | 0.21 | 0.27 | 0.32 |
| COMPARATIVE EXAMPLE 10 | 115 | 134 | 154 | 64 | 77 | 90 | 0.15 | 0.27 | 0.40 |

Surface Roughness

As illustrated in Table 4, in Examples 12 to 14, there is no significant difference in the surface roughness Ra in the longitudinal direction. In contrast, in Comparative Examples 9 and 10, there are differences in the surface roughness Ra in the longitudinal direction.

In Examples 12 to 14 and Comparative Examples 9 and 10, the surface temperature of the air-inlet-side portion 1U of the base body 1 is lower than the surface temperature of the intermediate portion 1M, and the surface temperature of the intermediate portion 1M is lower than the surface temperature of the air-outlet-side portion 1L. The surface temperature of the air-inlet-side portion 1U of the base body 1 is lower than the surface temperature of the air-outlet-side portion 1L of the base body 1 because the air with room temperature flows into a portion of the heating-and-drying furnace 30 on the air-inlet-side portion 1U side, becomes hot while flowing through the heating-and-drying furnace 30, and flows out of a portion of the heating-and-drying furnace on the air-outlet-side portion 1L side. Thus, the temperature of a portion of the polyimide precursor solution 5 (which has been applied onto the inner surface of the base body 1) on the air-inlet-side portion 1U side is lower than the temperature of a portion of the polyimide precursor solution 5 on the air-outlet-side portion 1L side.

In Comparative Example 9 in which the thickness of the polyimide precursor solution 5 is constant, the surface roughness Ra of the inner circumferential surface of the sliding layer 2, obtained after the baking process, is lower in a portion having a lower surface temperature than in a portion having a higher surface temperature. Comparative Examples 9 and 10 show that there is a relationship between the thickness of the polyimide precursor solution 5 and the surface roughness Ra of the inner circumferential surface of the sliding layer 2 obtained after the baking process. That is, the surface roughness Ra decreases as the thickness of the polyimide precursor solution 5 decreases, and increases as the thickness of the polyimide precursor solution 5 increases.

In Examples 12 to 14, the thickness of the polyimide precursor solution 5 is larger in a portion corresponding to the portion 1U, than in a portion corresponding to the portion 1M; and larger in the portion corresponding to the portion 1M, than in a portion corresponding to the portion 1L. With this relationship, the change in thickness of the polyimide precursor solution 5 covers the difference in surface temperature (1U<1M<1L) of the base body 1. That is, the thickness of a portion of the polyimide precursor solution 5 on a side on which the base body 1 has a lower temperature is made larger, and the thickness of a portion of the polyimide precursor solution 5 on a side on which the base body 1 has a higher temperature is made smaller for suppressing, in the longitudinal direction, the significant difference in the surface roughness Ra of the inner circumferential surface of the sliding layer 2 obtained after the baking process.

For example, in Example 12, a third position (1L) is defined in the up-and-down direction of the base body 1, and the thickness of a portion of the polyimide precursor solution 5 located at the third position is set at a third value (64 μm) in the coating process. In addition, a fourth position (1U) located above the third position is defined, and the thickness of a portion of the polyimide precursor solution 5 located at the fourth position is set at a fourth value (90 μm) thicker than the third value. That is, the base body 1 is coated with the polyimide precursor solution 5 such that the thickness of the polyimide precursor solution 5 is gradually decreased from the upper side toward the lower side in the direction in which the air flows. In addition, in the drying process, the solvent is vaporized such that the temperature of the outer circumferential surface of the portion of the base body 1 located at the lower third position is kept at a third temperature (153° C.), and that the temperature of the outer circumferential surface of the portion of the base body 1 located at the upper fourth position is kept at a fourth temperature (115° C.) lower than the third temperature.

Durability Evaluation

For the durability evaluation, a length Lb of the fixing belt 201 was measured in the initial state obtained before the durability test. In addition, a length La of the fixing belt 201 was measured in a state obtained after the durability test. In the durability test, 500,000 paper sheets GF-C081 (having 80 g/m$^2$ and made by Nippon Paper Industries Co., Ltd.) were fed to the fixing apparatus. Table 5 illustrates the lengths Lb and La of the fixing belt 201.

TABLE 5

| | LENGTH BEFORE DURABILITY TEST Lb(mm) | LENGTH AFTER DURABILITY TEST La(mm) | END-PORTION STATE AFTER DURABILITY TEST |
|---|---|---|---|
| EXAMPLE 12 | 336.4 | 336.1 | NO CONSPICUOUS CHANGE |
| EXAMPLE 13 | 336.5 | 336.2 | NO CONSPICUOUS CHANGE |
| EXAMPLE 14 | 336.5 | 336.3 | NO CONSPICUOUS CHANGE |
| COMPARATIVE EXAMPLE 9 | 336.4 | 335.3 | ABRASION POWDER ADHERED TO AIR INLET SIDE |
| COMPARATIVE EXAMPLE 10 | 336.5 | DAMAGED | AIR INLET SIDE END PORTION WAS DAMAGED |

As illustrated in Table 5, in Examples 12 to 14, the length of the fixing belt 201 obtained after the durability test was shorter by about 0.2 to 0.3 mm than the length of the fixing belt 201 obtained before the durability test. However, the end portions of the fixing belt 201 have no conspicuous change. In contrast, in Comparative Example 9, the length of the fixing belt 201 obtained after the durability test was shortened by about 1.1 mm. In addition, an end portion of the fixing belt 201 on the air-inlet-side portion 1U side had abrasion powder adhered to the end portion. In Comparative Example 10, an end portion of the fixing belt 201 on the air-inlet-side portion 1U side was damaged when 460,000 paper sheets had been fed.

In Comparative Examples 9 and 10, the surface roughness Ra of the inner circumferential surface of the sliding layer 2 varies in the longitudinal direction. Thus, it is considered that the frictional force between the sliding layer 2 and the member on which the sliding layer 2 slides varied in the fixing nip portion N, and that the fixing belt 201 had always been applied with force in one direction. Thus, it is considered that the state of the fixing belt 201 easily caused the wear of the end portion of the fixing belt 201. In contrast, in Examples 12 to 14, since the surface roughness Ra of the inner circumferential surface of the sliding layer 2 hardly varies in the longitudinal direction, the frictional force between the sliding layer 2 and the member on which the sliding layer 2 slides hardly varies in the fixing nip portion N. As a result, the fixing belt 201 is abutted against a member that regulates the fixing belt 201 from moving in the rotation-axis direction, by a smaller force, so that the end portion of the fixing belt 201 hardly wears, allowing the fixing belt 201 to have high durability.

As described above, in the fixing belt 201 of the present embodiment, the thickness of each portion of coating of the polyimide precursor solution 5 has a value in a proper range. As a result, the effective surface roughness Ra of the inner circumferential surface 2*d* of the sliding layer 2 is obtained, and the wear resistance of the fixing belt 201 increases in the rotational direction of the fixing belt 201. Therefore, the sliding layer 2 of the fixing belt 201 can suppress the torque up and the stick slip in its service life, and the wear resistance strength of the fixing belt 201 can be increased.

Note that the fixing belt 201 manufactured by using the manufacturing method of the present embodiment may have the feature of the fixing belt 201 of the first embodiment. That is, in the fixing belt 201 manufactured by using the manufacturing method of the present embodiment, the orientation ratio Ro of the filler 2*a* of the inner-circumferential-surface-side area 2*b* may be smaller than the orientation ratio Ro of the filler 2*a* of the base-body-side area 2*c*. In another case, the fixing belt 201 manufactured by using the manufacturing method of the present embodiment may have the feature of the fixing belt 201 of the second embodiment. That is, in the fixing belt 201 manufactured by using the manufacturing method of the present embodiment, the average diameter of the Benard cells 6 may be equal to or larger than 50 μm and smaller than 200 μm.

In addition, in the present embodiment, the description has been made for the case where the base-body-side temperature X and the inner-circumferential-surface-side temperature Y satisfy the relationship of 10° C.≤X−Y≤30° C. However, the present disclosure is not limited to this. Even when the relationship of 10° C.≤X−Y≤30° C. is not satisfied, the present disclosure is applicable as long as the surface roughness Ra is uniformed in a proper range.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-147983, filed Sep. 3, 2020 which is hereby incorporated by reference herein in its entirety.

What is claimed is:

1. A rotatable endless fixing belt configured to fix a toner image borne on a recording material to the recording material by heating the toner image, the fixing belt being configured to be nipped by a rotary member disposed outside the fixing belt and a backup member disposed inside the fixing belt, a nip portion being formed between the fixing belt and the rotary member by the fixing belt being nipped by the rotary member and the backup member, the nip portion being a portion in which the toner image is fixed to the recording material, the fixing belt comprising:

a base body; and a polyimide layer formed on an inner-circumferential-surface of the base body and configured to slide on the backup member in contact with the backup member, wherein the polyimide layer comprises a filler having shape anisotropy, and wherein an orientation ratio of the filler inclined with respect to a generating line of the fixing belt by a predetermined angle or less is smaller in a first area than in a second area in a cross section of the fixing belt taken along the generating line of the fixing belt, the first area being an area formed in an inner-circumferential-surface side of the polyimide layer in a thickness direction, and the second area being an area formed in a base-body side of the polyimide layer in the thickness direction.

2. The fixing belt according to claim 1, wherein the polyimide layer comprises a plurality of Benard cells formed on an inner circumferential surface of the polyimide layer and having an average diameter of 50 μm to smaller than 200 μm, and wherein an arithmetic average roughness of the inner circumferential surface of the polyimide layer is 0.20 μm to 0.50 μm.

3. A rotatable endless fixing belt configured to fix a toner image borne on a recording material to the recording material by heating the toner image, the fixing belt being configured to be nipped by a rotary member disposed outside the fixing belt and a backup member disposed inside the fixing belt, a nip portion being formed between the fixing belt and the rotary member by the fixing belt being nipped by the rotary member and the backup member, the nip portion being a portion in which the toner image is fixed to the recording material, the fixing belt comprising:

a base body; and a polyimide layer formed on an inner-circumferential-surface of the base body and configured to slide on the backup member in contact with the backup member, wherein the polyimide layer comprises a filler having shape anisotropy, wherein the polyimide layer comprises a plurality of Benard cells formed on an inner circumferential surface of the polyimide layer and having an average diameter of 50 μm to smaller than 200 μm, and wherein an arithmetic average roughness of the inner circumferential surface of the polyimide layer is 0.20 μm to 0.50 μm.

4. The fixing belt according to claim 3, wherein the filler has an aspect ratio of 5 to 200.

5. A method of manufacturing a fixing belt that fixes a toner image borne on a recording material to the recording material by heating the toner image, the fixing belt being configured to be nipped by a rotary member disposed outside the fixing belt and a backup member disposed inside the fixing belt, a nip portion being formed between the fixing belt and the rotary member by the fixing belt being nipped by the rotary member and the backup member, the nip portion being a portion in which the toner image is fixed to the recording material, the fixing belt comprising:

a base body and a polyimide layer formed on an inner-circumferential-surface of the base body; and configured to slide on the backup member in contact with the backup member, the method comprising:

coating an inner circumferential surface of the base body with a solution in which a precursor of the polyimide layer and a filler are dispersed in a solvent; and drying the solvent of the solution that has been applied onto the inner circumferential surface of the base body, wherein in the drying, the solvent is dried such that a difference between a first temperature and a second temperature is 10° C. to 30° C., where the first temperature is a temperature of an outer circumferential surface of the base body and the second temperature is an ambient temperature of an inner-circumferential-surface side of the polyimide layer that is lower than the first temperature.

6. The method according to claim 5, wherein in the drying, the solvent is dried such that a first fluid flows in an outer side of the base body, from one end side of the base body toward another end side of the base body in a rotation-axis direction of the base body, and a second fluid having a temperature lower than that of the first fluid flows in an inner side of the base body from the other end side toward the one end side.

7. The method according to claim 6, wherein in the coating, the inner circumferential surface of the base body is coated with the solution such that a portion of the solution located at a third position has a thickness that is a third value, and a portion of the solution located at a fourth position positioned closer to the other end side than the third position in the rotation-axis direction has a thickness that is a fourth value greater than the third value, and wherein in the drying, the solvent is dried such that a temperature of the outer circumferential surface of the base body obtained at the third position is a third temperature, and a temperature of the outer circumferential surface of the base body obtained at the fourth position is a fourth temperature lower than the third temperature.

8. The method according to claim 5, wherein the filler has an aspect ratio of 5 to 200.

* * * * *